US007946361B2

(12) United States Patent
Gurjar et al.

(10) Patent No.: US 7,946,361 B2
(45) Date of Patent: May 24, 2011

(54) FLOW OPERATED ORIENTER AND METHOD OF DIRECTIONAL DRILLING USING THE FLOW OPERATED ORIENTER

(75) Inventors: Rishi Gurjar, Edmonton (CA); Omar Neumann, Spring, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 62 days.

(21) Appl. No.: 12/355,568

(22) Filed: Jan. 16, 2009

(65) Prior Publication Data

US 2009/0183921 A1 Jul. 23, 2009

Related U.S. Application Data

(60) Provisional application No. 61/011,397, filed on Jan. 17, 2008.

(51) Int. Cl.

| | |
|---|---|
| ***E21B 7/04*** | (2006.01) |
| ***E21B 4/16*** | (2006.01) |
| ***F16D 11/04*** | (2006.01) |
| ***F16D 13/22*** | (2006.01) |
| ***F16D 25/061*** | (2006.01) |
| ***F16D 43/08*** | (2006.01) |

(52) U.S. Cl. ..... 175/61; 175/95; 175/101; 192/69.8; 192/85.18

(58) Field of Classification Search ..... 175/61, 175/95, 101, 106, 107; 192/108, 69.8–69.83, 192/85.18

See application file for complete search history.

(56) References Cited

U.S. PATENT DOCUMENTS

| | | | | |
|---|---|---|---|---|
| 3,463,252 | A | 8/1969 | Garrett et al. | |
| 3,586,116 | A | 6/1971 | Tiraspolsky et al. | |
| 3,896,667 | A | 7/1975 | Jeter | |
| 3,908,759 | A | 9/1975 | Cagle et al. | |
| 4,187,918 | A | 2/1980 | Clark | |
| 4,374,547 | A * | 2/1983 | Nguyen et al. | 175/45 |

(Continued)

FOREIGN PATENT DOCUMENTS

| | | |
|---|---|---|
| EP | 0497420 | 8/1992 |

(Continued)

OTHER PUBLICATIONS

Greener, "Transatlantic Synergy Helps Drill Better Horizontal Holes," Hart's Petroleum Engineer International, Aug. 1998, pp. 37, 40, vol. 71.

(Continued)

*Primary Examiner* — Jennifer H Gay

(74) *Attorney, Agent, or Firm* — Patterson & Sheridan, L.L.P.

(57) ABSTRACT

A bottom hole assembly (BHA) for use in drilling a wellbore includes: a first mud motor having a stator and a rotor; a second mud motor having a stator and a rotor; a drill bit rotationally coupled to the second rotor and having a tool face and a longitudinal axis inclined relative to a longitudinal axis of the first mud motor; and a clutch. The clutch is operable to: rotationally couple the second stator to the first stator in a first mode at a first orientation of the tool face, rotationally couple the first rotor to the second stator in a second mode, change the first orientation to a second orientation by a predetermined increment, orient the tool face at the second orientation in an orienting mode, and shift among the modes in response to a change in flow rate of a fluid injected through the clutch and/or a change in weight exerted on the drill bit.

26 Claims, 15 Drawing Sheets

U.S. PATENT DOCUMENTS 4,462,469 A 7/1984 Brown
4,678,045 A 7/1987 Lyons
4,760,759 A 8/1988 Blake
5,139,094 A 8/1992 Prevedel et al.
5,154,231 A 10/1992 Bailey et al.
5,186,265 A 2/1993 Henson et al.
5,215,151 A 6/1993 Smith et al.
5,277,251 A 1/1994 Blount et al.
5,287,921 A 2/1994 Blount et al.
5,311,952 A 5/1994 Eddison et al.
5,311,953 A 5/1994 Walker
5,314,030 A 5/1994 Peterson et al.
5,316,094 A 5/1994 Pringle
5,332,048 A 7/1994 Underwood et al.
5,339,913 A 8/1994 Rives
5,363,929 A 11/1994 Williams et al.
5,368,110 A 11/1994 French
5,373,898 A 12/1994 Pringle
5,392,867 A 2/1995 du Chaffaut et al.
5,394,951 A 3/1995 Pringle et al.
5,431,219 A 7/1995 Leising et al.
5,441,119 A 8/1995 Head
5,443,129 A 8/1995 Bailey et al.
5,450,914 A 9/1995 Coram
5,483,987 A 1/1996 Amaudric du Chaffaut et al.
5,485,889 A 1/1996 Gray
5,488,989 A 2/1996 Leising et al.
5,503,235 A 4/1996 Falgout, Sr.
5,535,835 A 7/1996 Walker
5,538,091 A 7/1996 Theocharopoulos
5,547,031 A 8/1996 Warren et al.
5,617,926 A 4/1997 Eddison et al.
5,636,178 A 6/1997 Ritter
5,647,436 A 7/1997 Braddick
5,669,457 A 9/1997 Sebastian et al.
5,673,764 A * 10/1997 Falgout, Sr. ..... 175/101
5,709,265 A 1/1998 Haugen et al.
5,725,060 A 3/1998 Blount et al.
5,735,357 A 4/1998 Palm
5,738,178 A 4/1998 Williams et al.
5,775,444 A 7/1998 Falgout, Sr.
5,787,978 A 8/1998 Carter et al.
5,826,651 A 10/1998 Lee et al.
5,831,177 A 11/1998 Waid et al.
5,836,406 A 11/1998 Schuh
5,887,655 A 3/1999 Haugen et al.
5,894,896 A 4/1999 Smith et al.
5,931,239 A 8/1999 Schuh
5,944,101 A 8/1999 Hearn
5,947,201 A 9/1999 Ross et al.
RE36,556 E 2/2000 Smith et al.
6,047,784 A 4/2000 Dorel
6,059,050 A 5/2000 Gray
6,082,453 A 7/2000 Bakke
6,082,457 A 7/2000 Best et al.
6,116,354 A 9/2000 Buytaert
6,129,160 A 10/2000 Williams et al.
6,158,529 A 12/2000 Dorel
6,158,533 A 12/2000 Gillis et al.
6,176,327 B1 1/2001 Hearn
6,216,802 B1 4/2001 Sawyer
6,241,032 B1 * 6/2001 Falgout, Sr. ..... 175/318
6,244,361 B1 6/2001 Comeau et al.
6,296,066 B1 10/2001 Terry et al.
6,315,062 B1 11/2001 Alft et al.
6,415,878 B1 7/2002 Cargill et al.
6,419,014 B1 7/2002 Meek et al.
6,439,321 B1 8/2002 Gillis et al.
6,446,737 B1 9/2002 Fontana et al.
6,454,007 B1 9/2002 Bailey
6,554,083 B1 4/2003 Kerstetter
6,561,289 B2 5/2003 Portman et al.
6,571,888 B2 6/2003 Comeau et al.
6,598,687 B2 7/2003 Eppink et al.
6,607,043 B1 8/2003 Sunde et al.
6,607,044 B1 8/2003 Eppink et al.
6,609,579 B2 8/2003 Krueger et al.
6,626,254 B1 9/2003 Krueger et al.
6,659,201 B2 12/2003 Head et al.
6,659,203 B1 12/2003 Cruickshank et al.
6,769,499 B2 8/2004 Cargill et al.
6,945,328 B2 9/2005 Cruickshank et al.
6,955,231 B1 10/2005 Bakke
7,028,789 B2 4/2006 Krueger et al.
7,178,611 B2 * 2/2007 Zupanick ..... 175/75
7,234,544 B2 6/2007 Kent
7,243,739 B2 * 7/2007 Rankin, III ..... 175/73
7,306,060 B2 12/2007 Krueger et al.
7,347,282 B2 3/2008 Betts et al.
7,467,672 B2 * 12/2008 Cruickshank ..... 175/61
7,481,282 B2 1/2009 Horst et al.
7,591,356 B2 * 9/2009 Guyader ..... 192/55.1
7,753,184 B2 * 7/2010 Traner ..... 192/43
2001/0022241 A1 9/2001 Portman et al.
2001/0052427 A1 12/2001 Eppink et al.
2002/0162659 A1 11/2002 Davis et al.
2002/0166701 A1 11/2002 Comeau et al.
2004/0089478 A1 5/2004 Cruickshank et al.
2004/0089480 A1 5/2004 Dewey
2005/0023037 A1 2/2005 Camp
2006/0254824 A1 11/2006 Horst et al.
2007/0107937 A1 5/2007 Sugiura
2007/0119678 A1 * 5/2007 Houle et al. ..... 192/69.8
2007/0235227 A1 10/2007 Kirkhope et al.
2007/0256865 A1 11/2007 Cruickshank
2009/0050370 A1 2/2009 Peters
2009/0183921 A1 * 7/2009 Gurjar et al. ..... 175/61
2010/0108383 A1 * 5/2010 Hay et al. ..... 175/26

FOREIGN PATENT DOCUMENTS

EP 0685628 12/1995
EP 0770759 5/1997
EP 0774563 5/1997
EP 0963502 9/1998
EP 1291486 3/2003
GB 227195 1/1925
GB 2326898 1/1999
GB 2426021 11/2006
WO WO-9310326 5/1993
WO WO-9619635 6/1996
WO WO-9716622 5/1997
WO WO-9838410 9/1998
WO WO-0100960 1/2001

OTHER PUBLICATIONS

"Economic Advantages of a New Straight-Hole Drilling Device," Journal of Petroleum Technology, Dec. 1999, pp. 26, 35, vol. 51.

Elsborg et al., "High Penetration Rate Drilling with Coiled Tubing," SPE 37074, presented at the 1996 SPE International Conference on Horizontal Well Technology in Calgary, Canada, on Nov. 18-20, 1996, pp. 333-343.

http://www.rotarysteerable.com/product.htm print date: Feb. 20, 2001.

http://www.halliburton.com/sperry-sun/services/drill/extend.asp print date: Feb. 20, 2001.

"Advanced BHAs Extend Capability, Boost Efficiency," Drilling Contractor, Jan./Feb. 2001, pp. 28-30.

"Drilling Equipment: Improvements from Data Recording to Slim Hole," Drilling Contractor, Mar./Apr. 2000, pp. 30-32.

Derkach, "High-Torque Gear Reducer Expands Turbodrill Capabilities," Oil and Gas Journal, Jul. 5, 1999 (at http://www.findarticles.com/cf.sub.—0/m3112/27.sub.—97/55221538/rint.jh- tml print date: Feb. 28, 2001).

"Directional Drilling: Improving Efficiency and Control," Drilling Contractor, Mar./Apr. 2000, pp. 44, 46.

Ridgen et al., "New Tool That Will Improve Coiled Tubing Directional Drilling," World Oil's 4.sup.th International Conference and Exhibition, Houston, Texas, Mar. 1996, pp. 1-6.

Leising et al., Extending the Reach of Coiled Tubing Drilling (Thrusters, Equalizer and Tractors), SPE 37656, SPE/IADC Drilling Conference, Mar. 4-6, 1997, pp. 1-14.

Sperry-Sun Drilling Services, "Predictable Torque and Bit Speed Delivered Directly to the Bit," 1991, 1998.

GB Search Report for Application No. GB0900706.3 dated Oct. 27, 2009, Claims 16-18.
GB Search Report for Application No. GB0900706.3 dated Oct. 27, 2009, Claims 19-26.
United Kingdom Search Report, Application No. GB0900706.3, dated May 13, 2009.

* cited by examiner

Surface Indicators

| Mode/Position | Flow Rate | Tool Face | Rate of Penetratioin |
|---|---|---|---|
| Neutral Position | 0 | Fixed | None |
| Rotary Mode | Drilling Rate | Rotating | High |
| Orienting Mode | Drilling Rate | Rotating | Low |
| Sliding Mode | Drilling Rate | Fixed | High |

FIG. 6A

FLOW OPERATED ORIENTER AND METHOD OF DIRECTIONAL DRILLING USING THE FLOW OPERATED ORIENTER

CROSS-REFERENCE TO RELATED APPLICATIONS

This application claims benefit of U.S. Provisional Patent Application No. 61/011,397, filed Jan. 17, 2008, which is hereby incorporated by reference in its entirety.

BACKGROUND OF THE INVENTION

1. Field of the Invention

Embodiments of the present invention generally relate to a flow operated orienter.

2. Description of the Related Art

Conventional directional drilling with a drillstring of jointed pipe is accomplished through use of a Bottom Hole Assembly (BHA) including a bent sub (typically one-half to three degrees), a drilling or mud motor, and directional Measurement While Drilling (MWD) tool in the following fashion. To drill a curved wellbore section, the drillstring is held rotationally fixed at the surface and the drilling motor will drill a curved wellbore in the direction or orientation of the bent sub. This is termed slide drilling because the entire drillstring slides along the wellbore as drilling progresses. The wellbore trajectory is controlled by orienting the BHA in the desired direction by rotating the drillstring the appropriate amount at the surface.

To drill a straight wellbore section, the drillstring is rotated at the surface with the rotary table or top-drive at some nominal rate, typically 60 to 90 rpm. This is termed rotary drilling. In so doing, the tendency of the mud motor to drill in a particular direction, due to the bent sub, is overridden by the superimposed drillstring rotation causing the drilling assembly to effectively drill straight ahead.

When drilling with coiled tubing, neither rotary drilling nor rotational orientation of the BHA can be accomplished without the addition to the BHA of a special rotating device to orient the BHA since coiled tubing cannot be rotated in the wellbore from the surface. One such rotational device, or orienter, operates by rotating in even angular increments, for example 30°, each time the surface pumps are stopped and then re-started. After each pump cycle, the orienter locks into and maintains its rotational position. This ratcheting device allows the directional driller to position the directional assembly closely enough to the desired toolface orientation to allow the wellbore to be drilled in a particular direction.

One drawback to directional drilling with the ratcheting orienter relates to its inability to drill an effective straight wellbore section. As discussed above, in conventional directional drilling, continuous drillstring rotation is used to negate the directional tendency of a bent-housing motor. This produces a very straight trajectory. When drilling with coiled tubing and a ratcheting orienter, continuous rotation is not possible. Thus the driller is forced to orient slightly left of the desired path and drill some distance ahead. Then after stopping to re-orient right of the desired path, the driller drills ahead again. This process is repeated until the "straight" section is completed. The resulting left-right-left or "wig-wag" wellbore trajectory roughly approximates the desired straight path.

For illustration and a more detailed discussion of rotary and sliding drilling, see U.S. Pat. No. 6,571,888, which is herein incorporated by reference in its entirety.

SUMMARY OF THE INVENTION

Embodiments of the present invention generally relate to a flow operated orienter. In one embodiment, a bottom hole assembly (BHA) for use in drilling a wellbore includes: a first mud motor having a stator and a rotor; a second mud motor having a stator and a rotor; a drill bit rotationally coupled to the second rotor and having a tool face and a longitudinal axis inclined relative to a longitudinal axis of the first mud motor; and a clutch. The clutch is operable to: rotationally couple the second stator to the first stator in a first mode at a first orientation of the tool face, rotationally couple the first rotor to the second stator in a second mode, change the first orientation to a second orientation by a predetermined increment, orient the tool face at the second orientation in an orienting mode, and shift among the modes in response to a change in flow rate of a fluid injected through the orienter clutch and/or a change in weight exerted on the drill bit.

In another embodiment, a clutch includes: a tubular housing; a rotary shaft disposed in the housing; a rotary jaw rotationally coupled to the rotary shaft; an output shaft disposed in the housing; an output jaw rotationally coupled to the output shaft and having an asymmetric jaw face; and an orienting jaw having an asymmetric jaw face. The clutch is fluid operable among: a rotary mode, wherein the rotary and output jaws are engaged, thereby rotationally coupling the rotary and output shafts, a sliding mode, wherein the asymmetric jaw faces are engaged and the orienting jaw is rotationally coupled to the housing, thereby rotationally coupling the output shaft and the housing, and an orienting mode, wherein the rotary and output jaws are disengaged, the asymmetric jaw faces are contacting and misaligned, and the orienting jaw is rotationally coupled to the housing.

In another embodiment, a method of directional drilling a wellbore, includes injecting drilling fluid through a coiled tubing string extending from the surface and into the wellbore and a bottom hole assembly (BHA) disposed in the wellbore and connected to an end of the coiled tubing string. The BHA includes a BHA motor, a drill bit motor, a drill bit having a tool face and a longitudinal axis inclined relative to a longitudinal axis of the BHA motor, and a clutch. The clutch engages the BHA motor with the bit motor in a rotary mode, thereby rotating the bit motor. The bit motor rotates the drill bit, thereby drilling the wellbore. The method further includes shifting the clutch to a sliding mode. The clutch: allows reactive rotation of the bit motor until the tool face is at a first orientation, rotationally couples the bit motor to the coiled tubing string at the first orientation, and disengages the BHA motor from the bit motor. The method further includes slide drilling the wellbore at the first orientation.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 6A is a table illustrating surface indicators for determining which mode the orienter is in. FIG. 6B is a flow chart illustrating a method for determining which operational mode the orienter is currently in.

DETAILED DESCRIPTION

Figure 1:
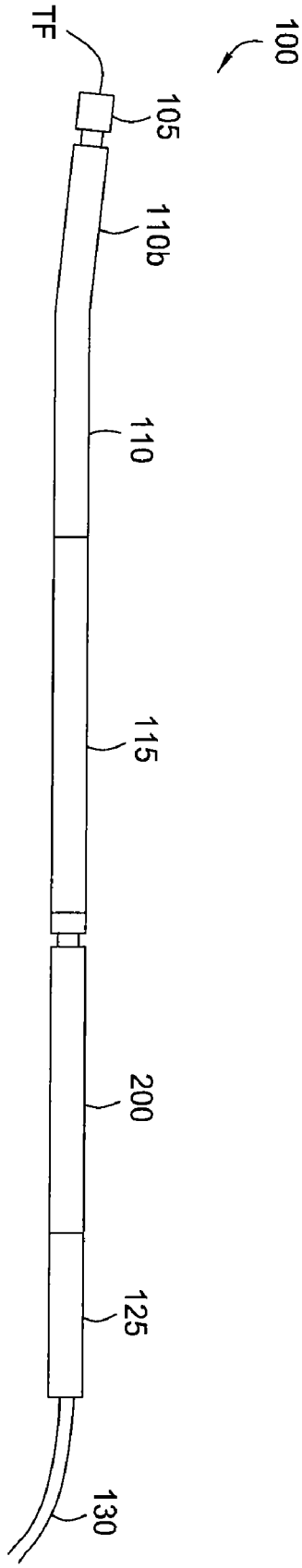
FIG. 1 is a diagram of a coiled tubing Bottom Hole Assembly (BHA), according to one embodiment of the present invention.
Figures 2A, 2B, 2C:
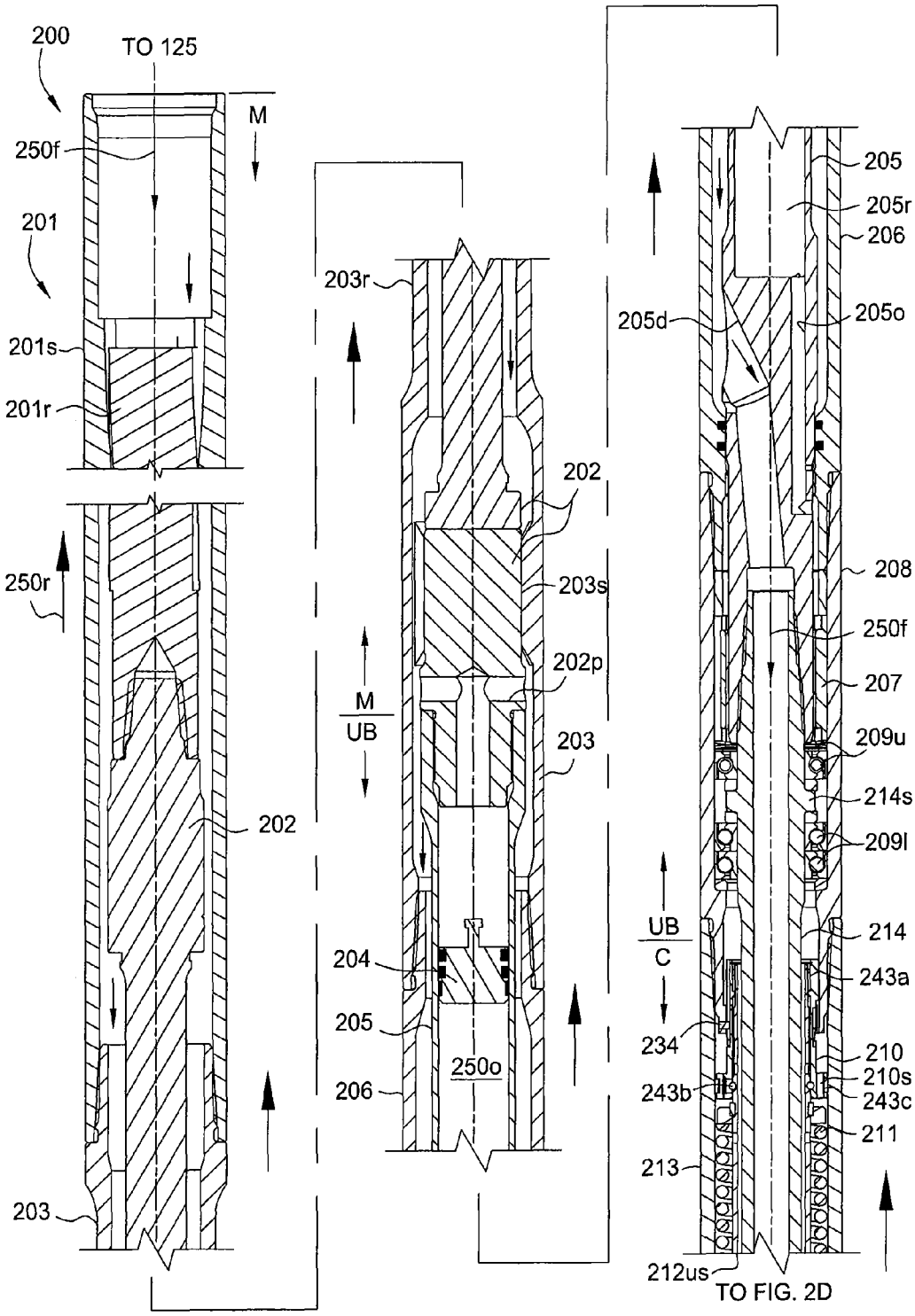
FIGS. 2A-2F are longitudinal sectional views of the orienter of FIG. 1.
Figures 2D, 2E, 2F:
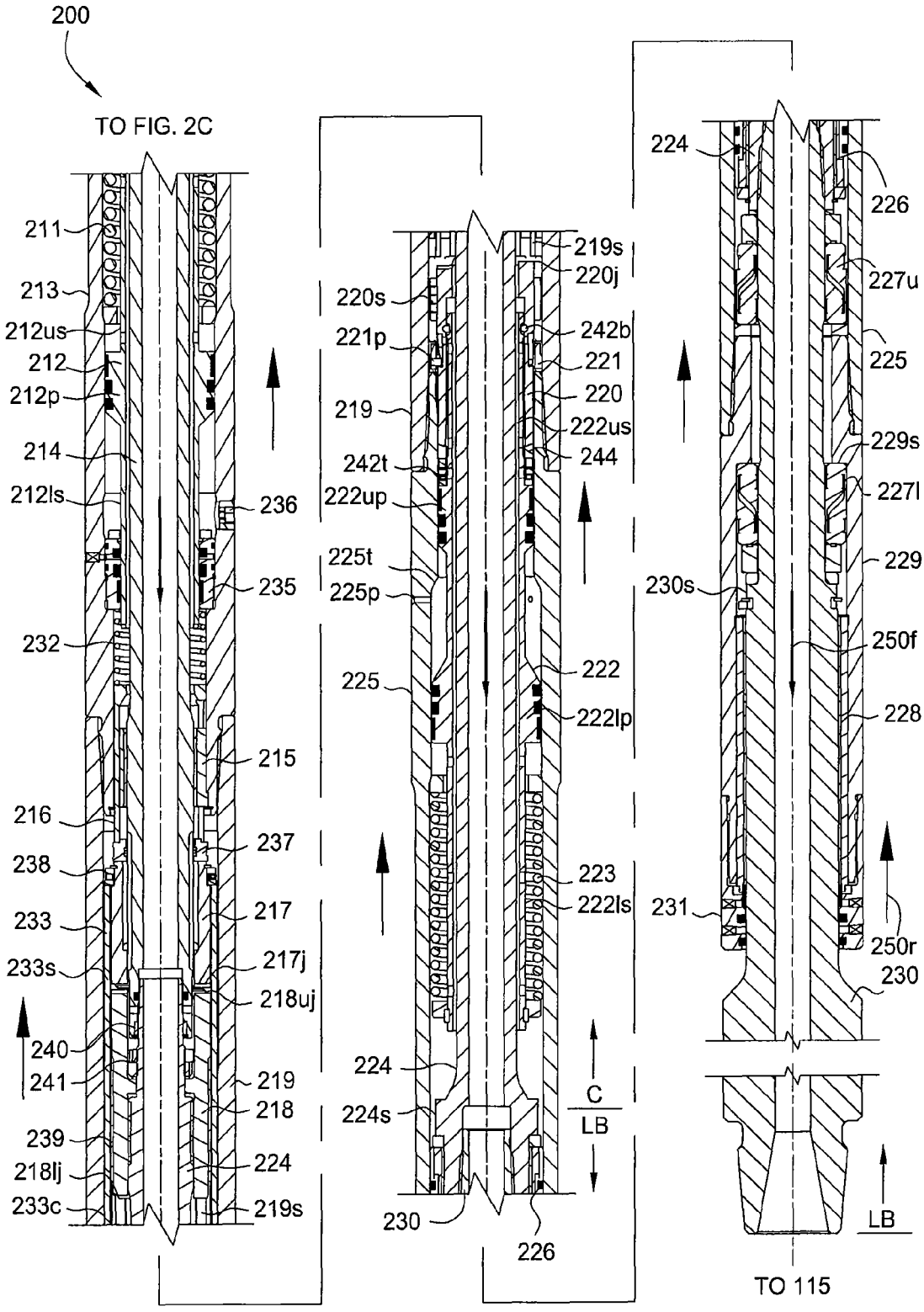

FIG. 1 is a diagram of a coiled tubing Bottom Hole Assembly (BHA) 100, according to one embodiment of the present invention. The coiled tubing BHA 100 may include: a drill bit 105, a first mud motor (or bit motor) 110, measurement while drilling (MWD) module 115, orienter 200, and an adapter 125. The bit motor 110 may harness fluid energy from drilling fluid by channeling it between a profiled rotor and stator, thereby imparting the energy into rotational motion of the rotor. The bit motor 110 may be a positive displacement motor (PDM), such as a Moineau motor, or a turbomachine, such as a centrifugal, axial flow, or mixed flow motor.

The drill bit 105 may be longitudinally and rotationally coupled to the rotor of the bit motor 110, such as by a threaded connection. The stator of the bit motor 110 may be disposed in and longitudinally and rotationally coupled to a housing of the bit motor 110. The rotor of the bit motor 110 may be disposed in the housing of the bit motor 110 and longitudinally coupled thereto by one or more bearings. The housing of the bit motor 110 may be bent, thereby inclining a longitudinal axis of the drill bit 105 and a lower portion 110*b* of the bit motor 110 relative to a longitudinal axis of the rest of the BHA 200 at a predetermined angle, such as one-half to three degrees. When rotated by the orienter 200, this inclination may cause eccentric rotation of a tool face TF of the drill bit 105, the drill bit 105, and/or the bent portion 110*b*. The bit motor 110 rotor may rotate the bit 105 when powered by drilling fluid and the bent housing may effect drilling in a curved direction when the bent housing is rotationally fixed. The bent housing may be longitudinally and rotationally coupled to the MWD module 115, such as by a threaded connection. Alternatively, a bent sub (not shown) may be longitudinally and rotationally coupled to a straight housing bit motor, such as by a threaded connection. Alternatively, the BHA 100 may be deployed with a string of drill pipe instead of coiled tubing 130.

The MWD module 115 may be longitudinally and rotationally coupled to a rotor of the orienter 200, such as by a threaded connection. MWD module 115 may include one or more sensors, such as a magnetometer and/or an accelerometer, to measure borehole inclination and/or direction and may further include a wireless transmitter, such as a mud pulser, to transmit the measurements to the surface. The MWD module 115 may further include a power source, such as a fluid operated generator and/or a battery. The adapter 125 may be longitudinally and rotationally coupled to a stator or housing of the orienter 200, such as by a threaded connection. The adapter 125 may be longitudinally and rotationally coupled to a string of coiled tubing 130, such as with a flange or union.

The BHA 100 may also include a pressure and/or temperature (PT) module for monitoring bottomhole pressure and/or temperature. The PT measurements may be transmitted to the surface using the mud pulser. The BHA 100 may further include an LWD module (not shown). The LWD module may include one or more instruments, such as spontaneous potential, gamma ray, resistivity, neutron porosity, gamma-gamma/formation density, sonic/acoustic velocity, and caliper. Raw data from these instruments may be transmitted to the surface using the mud pulser. The raw data may be processed to calculate one or more formation parameters, such as lithology, permeability, porosity, water content, oil content, and gas content as a formation is being drilled through (or shortly thereafter). Alternatively, instead of a mud pulser, the MWD, PT, and/or LWD data may be transmitted via a conductor embedded in the coiled tubing string or electromagnetic (EM) telemetry. The conductor may also provide power to the MWD, PT, and/or LWD modules.

FIGS. 2A-2F are longitudinal sectional views of the orienter 200. The orienter 200 may include a motor sub-assembly M, an upper bearing subassembly UB, a clutch subassembly C, and a lower bearing subassembly LB. The motor subassembly M may include a second (or BHA) mud motor 201 (any of the types, discussed above, PDM as shown) and an articulator 202, 203. An upper longitudinal end of the stator/housing 201*s* of the BHA motor 201 may be longitudinally and rotationally coupled to the adapter 125, such as with a threaded connection. The lower bearing subassembly LB may include an output shaft 230 longitudinally and rotationally coupled to the MWD module 115, such as with a threaded connection.

The orienter 200 may include three operating modes: rotary drilling mode, sliding drilling mode, and orienting mode and two shifting positions: neutral and bypass. In the rotary mode, the clutch C may rotationally couple the BHA rotor 201*r* to the output shaft 230, thereby rotating the bent housing 110 (continuously changing the tool face TF orientation) and negating the curved propensity imparted by the bent housing 110. In the sliding mode, the clutch C may rotationally couple the output shaft 230 to a stator or housing of the orienter 200, such as jaw housing 219, thereby rotationally fixing the bent housing 110 at a particular setting or orientation and allowing the bent housing 110 to impart curvature to the drilling path of the bit 105. The shifting positions may each be used to shift the clutch C between the rotary and sliding modes. If the clutch C is shifted between rotary and sliding modes using the neutral position, then the tool face setting or orientation may be changed by a predetermined angular increment. The predetermined angular increment may range from five to forty-five degrees, such as thirty-six degrees. If the clutch C is shifted between rotary and sliding modes using the bypass position, then the tool face setting or orientation may not be changed. When shifting from the rotary mode to the sliding mode, the clutch C may enter the orienting mode either to restore a previous tool face setting or to enter a new tool face setting depending on the shifting position employed. In the orienting mode, the clutch C may allow the output shaft 230 to be rotated by reaction torque from the bit motor 110 until the tool face TF setting is achieved and then shift into sliding mode at the tool face setting TF.

Operation of the orienter 200 among the three modes may be accomplished using a pressure differential between higher pressure drilling fluid 250*f* injected through the orienter 200 and lower pressure drilling fluid (and cuttings, collectively returns 250*r*) returning from the drill bit 105 to the surface via an annulus formed between an outer surface of the coiled tubing string 130 and the BHA 100 and an inner surface of the wellbore. The pressure differential between the drilling fluid 250*f* and returns 250*r* may be controlled by controlling an injection rate of a rig mud pump (not shown) and/or controlling weight exerted on the drill bit 105 by controlling a lifting force exerted by the drilling rig (not shown) on the coiled tubing string 130. Decreasing the injection rate of the drilling fluid 250*f* may decrease the pressure differential and vice versa. Decreasing a weight exerted on the drill bit 105 may decrease the pressure differential and vice versa. Other factors that may affect differential pressure are drilling fluid properties (i.e., density), drill bit motor pressure drop, coiled tubing string pressure drop, and drill bit pressure drop.

The articulator may include a shaft 202 and a housing 203. An upper longitudinal end of the articulator shaft 202 may be longitudinally and rotationally coupled to a lower longitudinal end of the BHA rotor 201*r*, such as by a threaded connection, and a lower longitudinal end of the articulator shaft 202 may be longitudinally and rotationally coupled to the crossover shaft 205, such as by a threaded connection. The articulator shaft 202 may include sub-shafts longitudinally and rotationally coupled to one another by one or more articulating joints (not shown see '888 patent), such as universal joints or constant velocity joints. The articulating joints may convert eccentric rotation of the BHA rotor 201*r* to concentric rotation. The articulating joints may also accommodate bending of the orienter stator. Alternatively, if a turbo-motor is used instead of the PDM 201, the articulator 202, 203 may be replaced by a speed reducing gearbox. The articulator shaft 202 may further include a balance port 202*p* providing fluid communication between an annulus, formed between the articulator shaft 202 and the articulator housing 203, and a bore of the crossover shaft 205.

An upper longitudinal end of the articulator housing 203 may be longitudinally and rotationally coupled to a lower longitudinal end of the BHA stator/housing 201*s*, such as by a threaded connection, and a lower longitudinal end of the articulator housing 203 may be longitudinally and rotationally coupled to an upper longitudinal end of the crossover housing 206, such as by a threaded connection. The articulator housing 203 may include a recessed outer surface 203*r* extending along a portion thereof relative to an outer surface of the rest of the orienter stator. The recessed outer surface 203*r* may accommodate flexing of the orienter stator. The articulator housing 203 may further include a bearing surface, such as longitudinal splines 203*s*, extending from an inner surface thereof. The splines 203*s* may provide radial support for the articulator shaft 202.

The upper bearing subassembly UB may include a balance piston 204, the crossover shaft 205, the crossover housing 206, one or more bearings 207, 209*u*, 209*l*, an upper bearing housing 208, and an upper portion of a rotary shaft 214. A lower longitudinal end of the crossover shaft 205 may be longitudinally and rotationally coupled to an upper longitudinal end of the rotary shaft 214, such as by a threaded connection. The balance piston 204 may be disposed in the crossover shaft bore. The balance piston 204 and a portion of the crossover shaft 205 below the balance piston may define a lubricant reservoir 205*r*. The balance piston 204 may equalize fluid pressure of the drilling fluid 250*f* from the balance port 202*p* with fluid pressure of a liquid lubricant, such as clean oil 250*o*, and include one or seals engaging an inner surface of the crossover shaft 205 and isolating drilling fluid 250*f* from the lubricant 250*o*. The balance piston 204 may longitudinally move relative to the crossover shaft 205, thereby allowing the reservoir 205*r* to be variable.

The crossover shaft 205 may further include a drilling fluid crossover port 205*d* and a lubricant crossover port 205*o*. The drilling fluid crossover port 205*d* may conduct drilling fluid 250*f* from an annulus, formed between the crossover shaft 205 and the crossover housing 206, to a bore of the rotary shaft 214. The lubricant crossover port 205*o* may conduct lubricant 250*o* between the reservoir 205*r* and an annulus, formed between the crossover shaft 205 and the upper bearing housing 208. One or more seals may be disposed between the crossover shaft 205 and the crossover shaft 206 to isolate the crossover annulus from the rotary shaft-upper bearing housing annulus.

A lower longitudinal end of the upper bearing housing 208 may be longitudinally and rotationally coupled to an upper longitudinal end of a rotary housing 213. A radial bearing, such as a journal bearing 207, may be radially disposed between the upper bearing housing 208 and the crossover shaft 205 and longitudinally disposed between the lower longitudinal end of the crossover housing 206 and the upper bearings 209*u*. One or more upper radial and/or thrust bearings 209*u*, such as a rolling element (i.e., ball) and a Michell bearing, may be disposed longitudinally between a lower longitudinal end of the bushing 207 and a shoulder 214*s*, extending from an outer surface of the rotary shaft 214, and radially between the rotary shaft 214 and the upper bearing housing 208. One or more lower radial and/or thrust bearings 209*l*, such as rolling element (i.e., ball) bearings, may be disposed longitudinally between the shoulder 214*s* and a shoulder, formed along an inner surface of the upper bearing housing 208, and radially between the rotary shaft 214 and the upper bearing housing 208.

The clutch subassembly C may include the lower longitudinal end of the upper bearing housing 208, a rotary cam 210, a rotary cam spring 211, a rotary piston 212, a rotary housing 213, the rotary shaft 214, a radial bearing 215, a rotary actuator 216, a rotary jaw 217, an output jaw 218, a jaw housing 219, an orienting cam/jaw 220, an orienting piston 222, an orienting spring 223, a orienting shaft 224, an orienting housing 225, a rotary jaw spring 232, and a jaw shifter 233.

The rotary cam 210 may include a cam profile 210*c* (see FIG. 3A), such as a J-slot, formed in an outer surface thereof. A guide, such as a pin 234, may be fastened to the lower longitudinal end of the upper bearing housing 208 and extend into the J-slot 210*c*, thereby operably coupling the rotary cam 210 to the upper bearing housing 208. The rotary cam 210 may be longitudinally coupled to the rotary piston 212, such as by a ball-groove connection 243*b*. The ball-groove connection 243*b* and a radial bearing, such as needle bearing 243*a*, may be radially disposed between the rotary piston 212 and the rotary cam 210 to allow the rotary cam 210 to rotate relative to the rotary piston 212. A lower longitudinal end of the rotary cam 210 may form an enlarged shoe 210*s* and the shoe may engage an inner surface of the rotary housing 213, thereby radially coupling the rotary cam 210 and the rotary housing 213. Rolling elements, such as rollers 243*c*, may be disposed in an outer surface of the rotary cam 210 so that the rotary cam 210 may freely rotate relative to the rotary housing 213.

The shoe 210*s* may have a longitudinal lubricant port formed therethrough allowing free flow of lubricant 250*o*. The shoe 210*s* may engage the lower longitudinal end of the upper bearing housing 208 in the neutral position. One or more keys 210*k* (see FIG. 3A) may extend from an outer surface of the rotary cam 210. The keys 210*k* may engage corresponding keys extending from an inner surface of the upper bearing housing 208 in sliding mode and may engage keyways formed between the upper bearing housing keys (and vice versa) in rotary mode.

The rotary cam 210 may also be disposed around the rotary piston 212. The rotary piston 212 may include an upper sleeve portion 212*us*, a piston portion 212*p*, and a lower sleeve portion 212*ls*. The rotary piston 212 may be disposed around the rotary shaft 214 such that an annulus may be formed between the rotary piston 212 and the rotary shaft 214. The annulus may serve as a lubricant 250*o* conduit. An upper spring stop may be longitudinally coupled to the rotary piston 212, such as with a fastener (i.e., a snap ring). A lower spring stop may be longitudinally coupled to the cam housing 213, such as with engaging shoulders. The cam spring 211, such as a coil spring or other biasing member, may be radially disposed between the rotary housing 213 and the rotary piston 212 and longitudinally abut the two stops, thereby biasing the rotary piston 212 longitudinally away from the rotary jaw 217.

The piston portion 212*p* may be an enlarged portion having an outer surface engaging an inner surface of the rotary housing 213. One or more seals may be disposed in the outer surface of the piston portion 212*p* and may isolate an upper longitudinal end from a lower longitudinal end. The upper longitudinal end may be in fluid communication with the lubricant reservoir 205*r* and the lower longitudinal end may be in fluid communication with the returns 250*r* via a radial port 236 formed through a wall of the rotary housing 213. The radial port 236 may have a filter fastened therein, such as with a threaded connection, for preventing entry of cuttings from the returns 250*r*. A plug 235 may be longitudinally coupled to the rotary housing 213, such as by a threaded connection. One or more seals may be disposed in an outer surface of the plug 235 and one or more seals may be disposed in an inner surface of the plug 235. The plug seals may isolate a lower piston chamber (in fluid communication with the returns 250*r*) from an annulus formed between the rotary piston 212 and the rotary housing 213 which may be in fluid communication with the lubricant reservoir 205*r*.

The rotary jaw spring 232 may longitudinally abut a lower longitudinal end of the plug 235 and an upper longitudinal end of the rotary actuator 216, thereby longitudinally biasing the rotary actuator 216 toward the output jaw 218. The rotary jaw spring 232 may be radially disposed between the cam housing 213 and the rotary shaft 214 and/or rotary piston 212. The upper longitudinal end of the rotary actuator 216 may also receive a lower longitudinal end of the lower sleeve portion 212*ls* in rotary mode. The lower longitudinal end of the lower sleeve portion 212*ls* may have one or more notches formed radially therethrough providing lubricant communication in rotary mode. The lower longitudinal end of the rotary actuator 216 may abut a thrust bearing 237. The thrust bearing 237 may also abut an upper longitudinal end of the rotary jaw 217, thereby longitudinally coupling the rotary actuator 216 and the rotary jaw 217 while permitting relative rotation therebetween. The rotary actuator 216 may be a sleeve and may include one or more windows radially formed through a wall thereof. The radial bearing 215 may be a journal bearing and include an outer journal longitudinally and rotationally coupled to the cam housing and an inner journal longitudinally and rotationally coupled to the rotary shaft 214. The outer journal of the radial bearing 215 may include one or more enlarged outer diameter portions extending through a respective window of the rotary actuator 216 and a reduced diameter portion radially disposed between the rotary sleeve 216 and the rotary shaft 214.

A recess may be formed in the upper longitudinal end of the rotary jaw 217. A thrust bearing 238 may be disposed along the recess and longitudinally between a fastener of the rotary jaw 217 and an upper longitudinal end of the jaw shifter 233. The thrust bearing 238 may permit rotation of the rotary jaw 217 relative to the jaw shifter 233. The rotary jaw 217 may be rotationally coupled to the rotary shaft 214 and free to move longitudinally relative thereto, such as with a ball-spline connection (balls not shown). The rotary jaw 217 may include a jaw face 217*j*, such as a crown, spiral, or square, formed in the lower longitudinal end thereof. The jaw face 217*j* may mesh with a mating jaw face 218*uj* formed in an upper longitudinal end of the output jaw 218 in the rotary mode, thereby rotationally coupling the rotary shaft 214 and the orienting shaft 224. The jaw faces 217*j*, 218*uj* may be symmetric A recess may be formed in a lower longitudinal end of the rotary shaft 214. An upper longitudinal end of the orienting shaft 224 may be received by the rotary shaft recess. A radial bearing 240, such as a needle bearing, may be radially disposed between the lower longitudinal end of the rotary shaft 214 and the upper longitudinal end of the orienting shaft 214 for permitting relative rotation therebetween (in sliding mode) and one or more seals may also be disposed therebetween for isolating the drilling fluid 250*f* from the lubricant 250*o*. One or more lubricant ports may be radially formed through the lower longitudinal end of the rotary shaft 214.

The output jaw 218 may be longitudinally and rotationally coupled to the orienting shaft 224. The output jaw 218 may include a lower splined portion, a central shoulder, and an upper recessed portion. The orienting shaft 224 may include a splined portion mating with the splined portion of the output jaw 218, thereby rotationally coupling the orienting shaft and the output jaw. The orienting shaft 224 may include a tapered shoulder formed along an outer surface thereof proximately below the splined portion for abutting the splines of the output jaw 218. The orienting shaft 224 may further include a threaded portion proximately above the splined portion for receiving one or more threaded fasteners, such as nuts 241. The nuts 241 may abut the shoulder portion of the output jaw 218, thereby longitudinally coupling the orienting shaft 224 and the output jaw 218. The recessed portion of the output jaw 218 may receive the lower longitudinal end of the rotary shaft 214.

A lower longitudinal end of the rotary housing 213 may be longitudinally and rotationally coupled to an upper longitudinal end of the jaw housing 219, such as with a threaded connection. The jaw housing 219 may include a splined portion 219*s* formed along an inner surface thereof. The jaw shifter 233 may be rotationally coupled to the jaw housing 219. The jaw shifter 233 may include an upper sleeve portion 233*s* and a lower collet portion 233*c*. The lower collet portion 233*c* may include one or more fingers and each finger may be disposed between splines of the splined portion 219*s*, thereby rotationally coupling the jaw shifter 233 and the jaw housing 219. The splined portion 219*s* may also serve as a longitudinal stop for the upper sleeve portion 233*s* in neutral position (the jaw shifter 233 may longitudinally float between the thrust bearing 238 and the stop in the neutral position, see FIG. 3B). A radial bearing 239, such as a journal, may be radially disposed between the output jaw 218 and the collet portion 233*c*/splined portion 219*s*. The radial bearing 239 may allow rotation of the output jaw 219 relative to the collet portion 233*c*/splined portion 219*s* in rotary mode.

The orienting cam/jaw 220 may include a jaw face 220*j*, a cam profile 220*c* (see FIG. 3B), and one or more splines 220*s*. The splines 220*s* may extend from an outer surface of the orienting cam/jaw 220 and may mate with the splined portion

219*s* in sliding mode, orienting mode, and rotary mode, thereby rotationally coupling the cam/jaw 220 and the jaw housing 219. The splines 220*s* may also engage the collet portion 233*c* in sliding mode and orienting mode, thereby longitudinally pushing and disengaging the rotary jaw 217 from the output jaw 218.

Figure 5A:
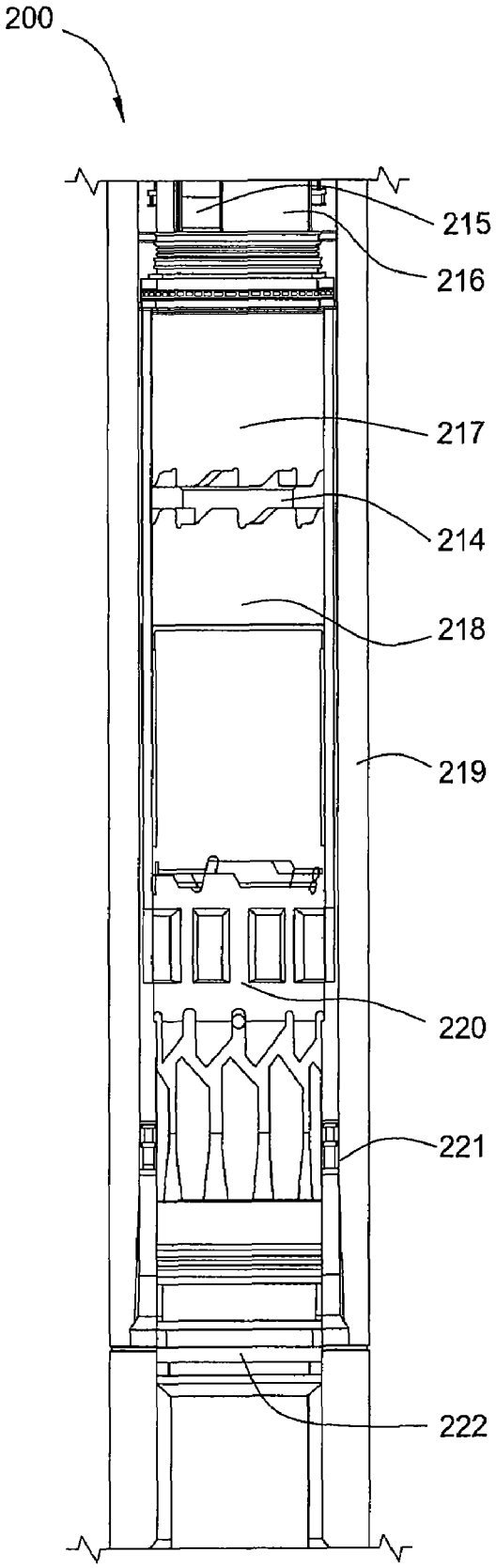
FIGS. 5A and 5B are isometric views illustrating a portion of the clutch subassembly in the orienting mode.
Figure 5B:
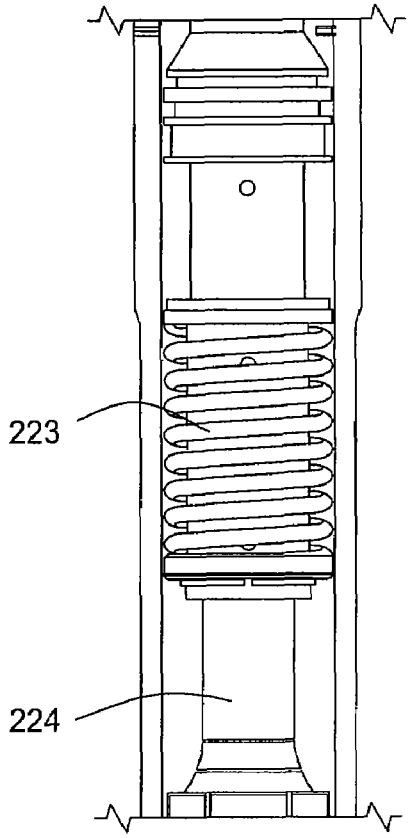
Figure 5C:
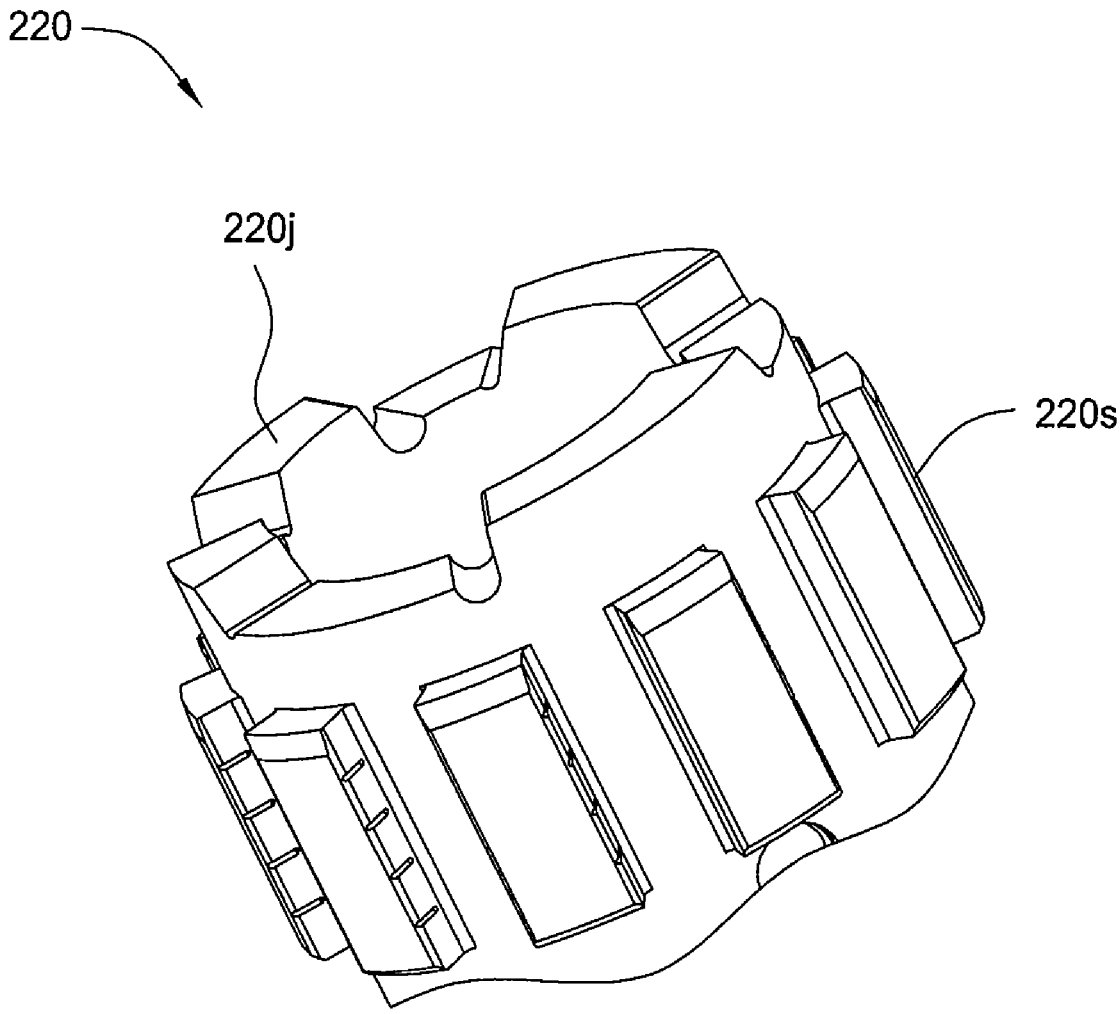
FIG. 5C is an isometric view illustrating the asymmetric jaw face of the orienting cam/jaw.

FIG. 5C is an isometric view illustrating the asymmetric jaw face 220*j* of the orienting cam/jaw 220. The jaw face 220*j* may be a crown, spiral, or square and formed in an upper longitudinal end of the cam/jaw 220. The jaw face 220*j* may mesh with a mating jaw face 218*lj* formed in a lower longitudinal end of the output jaw 218 in sliding mode, thereby rotationally coupling the orienting shaft 224 and the jaw housing 219. The orienting jaw face 220*j* may be asymmetric and may include two or more teeth, each tooth having a unique shape relative to the other teeth. The output jaw face 218*lj* may be correspondingly asymmetric so that the two jaw faces 218*lj*, 220*j* may only engage or mesh in a single rotational alignment.

Returning to FIGS. 2A-2F, the cam profile 220*c* may be a J-slot formed in an outer surface of the cam/jaw 220. A guide body 221, such as a ring, may be longitudinally and rotationally coupled to the jaw housing 219 and/or the orienting housing 225. The splines 220*s* may engage the guide body 221 in the neutral position. A guide, such as a pin 221*p*, may be fastened to a guide body 221 and extend into the J-slot 220*c*, thereby operably coupling the cam/jaw 220 to the orienting housing 225.

The cam/jaw 220 may be longitudinally coupled to the orienting piston 222, such as by a ball-groove connection 242*b* and a thrust bearing 242*t*. The ball-groove connection 242*b* may be radially disposed between the orienting piston 222 and the cam/jaw 220 and the thrust bearing 242*t* may be longitudinally disposed between a lower longitudinal end of the cam/jaw 220 and an upper longitudinal end of an upper piston portion 222*up* of the orienting piston 222 to allow the cam/jaw 220 to rotate relative to the orienting piston 222. The grooves of the ball-groove connection 242*b* may be oversized, the lower longitudinal end of the cam/jaw 200 may be conical, and a thrust disc 244 may be longitudinally disposed between the thrust bearing 242*t* and the lower longitudinal end of the cam/jaw 220 and have a mating conical upper longitudinal end to form an articulating connection between the cam/jaw 220 and the orienting piston 222. The articulating connection may facilitate engagement of the asymmetric jaw faces 218*lj*, 220*j*.

The cam/jaw 220 may also be disposed around the orienting piston 222. The orienting piston 222 may include an upper sleeve portion 222*us*, an upper piston portion 222*up*, a lower piston portion 222*lp*, and a lower sleeve portion 222*ls*. The orienting piston 222 may be disposed around the orienting shaft 224 such that an annulus may be formed therebetween. The annulus may serve as a lubricant 250*o* conduit. An upper spring stop may be longitudinally coupled to the orienting housing 225, such as with engaging shoulders. A lower spring stop may be longitudinally coupled to the orienting piston 222, such as with a fastener (i.e., a snap ring). The orienting spring 223, such as a coil spring or other biasing member, may be radially disposed between the orienting housing 225 and the orienting piston 222 and longitudinally abut the two stops, thereby biasing the orienting piston longitudinally away from the output jaw 218.

The orienting spring 223 may have a substantially lesser stiffness (i.e., substantially lesser length and/or thickness) than a stiffness of the rotary cam spring 211 such that a substantially lesser pressure, exerted on the orienting piston 222, is required to compress the rotary cam spring 211 than the pressure required on the rotary piston 212 to compress the rotary cam spring 211. This substantial stiffness differential may allow the orienter 200 to be shifted between sliding and rotary modes without entering the neutral position. As discussed more below, skipping the neutral position may be achieved by rotating or indexing the rotary cam 210 without indexing the orienting cam profile 220*c*.

Each of the piston portions 222*up*, 222*lp* may be an enlarged portion having an outer surface engaging an inner surface of the orienting housing 225. An inner surface of the orienting housing 225 may taper 225*t* (longitudinally downward) from a reduced diameter to an enlarged diameter so that an outer diameter of the upper piston portion 222*up* is less than an outer diameter of the lower piston portion 222*lp*. One or more seals may be disposed in the outer surface of each piston portion 222*up*, 222*lp* and may isolate an upper longitudinal end from a lower longitudinal end of each piston portion 222*up*, 222*lp*. An upper longitudinal end of the upper piston 222*up* and a lower longitudinal end of the lower piston 222*lp* may be in fluid communication with the lubricant reservoir 205*r* and a lower longitudinal end of the upper piston 222*up* and an upper longitudinal end of the lower piston 222*lp* may be in fluid communication with the returns 250*r* via a radial port 225*p* formed through a wall of the orienting housing 225.

When an increased lubricant 250*o* pressure (relative to the returns 250*r* or annulus pressure) is exerted on the piston portions 222*up*, 222*lp*, the upper piston 222*up* may partially counteract the lower piston 222*lp*, since the upper piston may have a reduced piston area relative to the lower piston area. This partial counteraction may reduce a net effective piston area of the orienting piston 222 relative to the rotary piston 212. The radial port 225*p* may or may not have a filter fastened therein, such as with a threaded connection, for preventing entry of cuttings from the returns 250*r*.

The lower bearing subassembly LB may include a lower portion of the orienting shaft 224, a lower portion of the orienting housing 225, one or more bearings 226, 2271, 227*u*, 228, a lower bearing housing 229, an output shaft 230, and a cap 231. A lower longitudinal end of the orienting shaft 224 may be longitudinally and rotationally coupled to an upper longitudinal end of the output shaft 230, such as by a threaded connection. The bearing 226 may be a radial bearing for radially supporting and centralizing rotation of the orienting shaft 224 from the orienting housing 225. The radial bearing 226 may be a journal bearing including an inner journal longitudinally and rotationally coupled to the orienting shaft 224, such as by a press fit and an outer journal longitudinally and rotationally coupled to the orienting housing, such as by one or more seals to mimic a press fit or a press fit. The radial bearing 226 may be longitudinally disposed between a shoulder 224*s* extending from the outer surface of the orienting shaft 224 and a fastener. Each of the bearings 227*u*, 2271 may be thrust bearings, such as rolling element bearings, for supporting longitudinal loads during drilling, such as weight exerted on the drill bit 105 by the coiled tubing string 130. The upper thrust bearing 227*u* may be longitudinally disposed between a lower longitudinal end of the orienting shaft 224 and an upper longitudinal end of the lower bearing housing 229 and radially disposed between the orienting housing 225 and the output shaft 230.

A lower longitudinal end of the orienting housing 225 may be longitudinally and rotationally coupled to an upper longitudinal end of the lower bearing housing 229, such as by a threaded connection. The lower thrust bearing 227*u* may be longitudinally disposed between a shoulder 229*s* of the lower bearing housing 229 and a shoulder 230*s* of the output shaft 230 and radially disposed between the lower bearing housing 229 and the output shaft 230. The bearing 228 may be a radial bearing, such as a journal bearing, for radially supporting and centralizing rotation of the output shaft 230 from the lower bearing housing 230 and carrying radial load generated by bending of the orienter 200 during drilling. The radial bearing 228 may include an inner journal longitudinally and rotationally coupled to the output shaft 230 and an outer journal longitudinally and rotationally coupled to the lower bearing housing 229.

The cap 231 may be longitudinally and rotationally coupled to the lower bearing housing 229, such as by a threaded connection. The cap 231 may include one or more seals engaging an outer surface of the output shaft 230 and isolating lubricant 250*o* in the orienter shaft-housing annulus from the returns 250*r*. A lower longitudinal end of the output shaft may 230 may be longitudinally and rotationally coupled to the MWD module 115, such as by a threaded connection.

The housings 203, 206, 208, 213, 219, 225, 229 of the orienter 200 may each be tubular and have a central longitudinal bore formed therethrough. The shafts 205, 214, 224, 230 of the orienter 200 may each be tubular members and, with the exception of the crossover shaft 205, each have a central longitudinal bore formed therethrough. The housings and shafts may each be made from a metal or alloy, such as steel, stainless steel, or specialty alloy, depending on the specific wellbore conditions. The jaws 217, 218, 220, and cam 210 may be made from a metal or alloy, such as steel or stainless steel and may be hardened to resist wear or made from a wear resistant metal or alloy, such as tool steel. The seals may be made from a polymer, such as an elastomer, and are denoted by black filling in FIGS. 2A-2F. The use of directional terms, such as upper and lower, may be arbitrary as the orienter 200 may be disposed in deviated or horizontal wellbores.

Figures 3A, 3B, 3C:
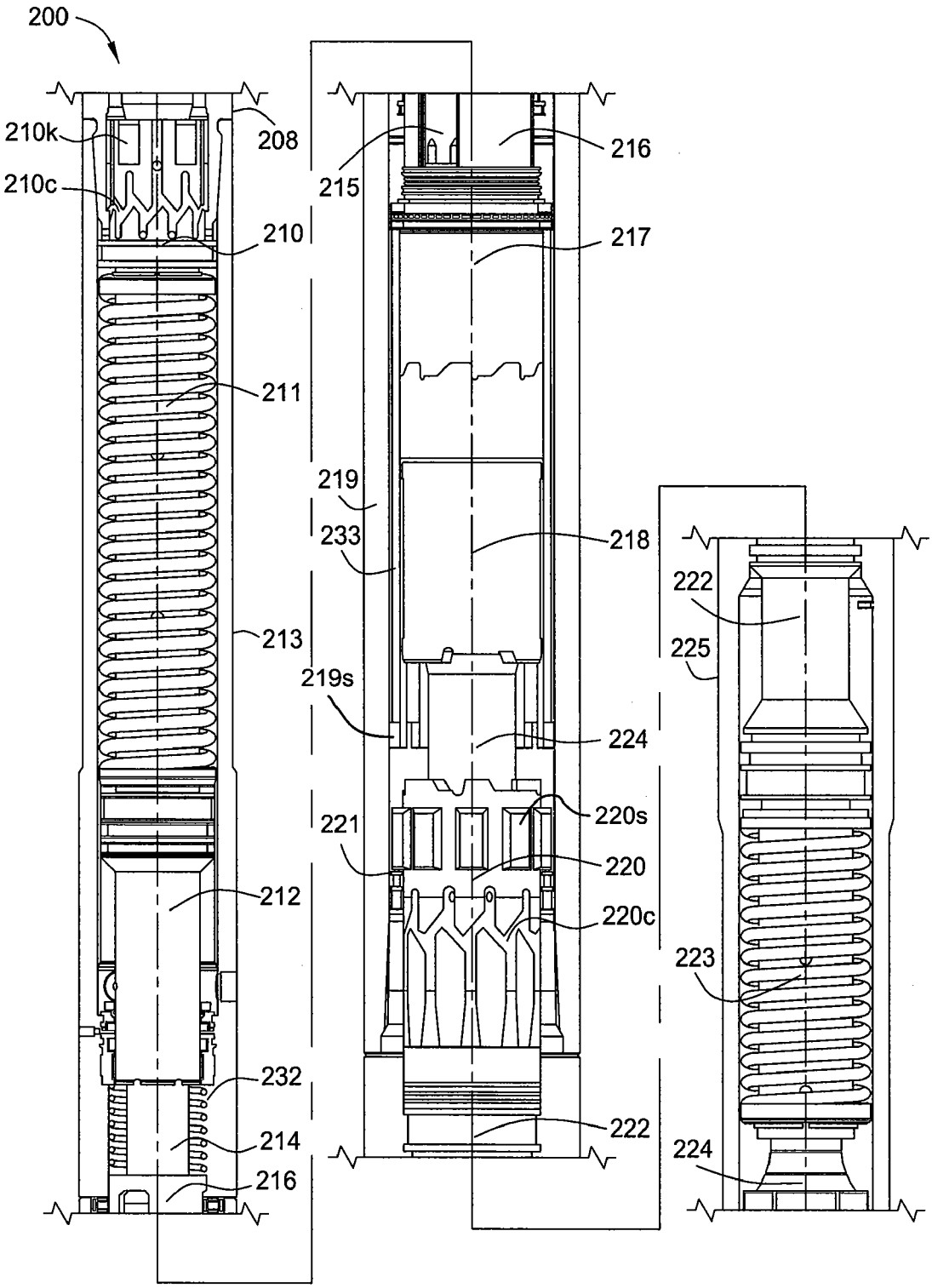
FIGS. 3A-3C are isometric views illustrating the clutch subassembly of the orienter in a neutral position.

FIGS. 3A-3C are isometric views illustrating the clutch subassembly C of the orienter 200 in a neutral position. The neutral position may be used to shift the orienter between the rotary and sliding modes and change the tool face setting. To shift the orienter to the neutral position, injection of the drilling fluid 250*f* may be ceased or substantially ceased from a first predetermined flow rate, such as a flow rate sufficient to sustain drilling. The pressure differential between the drilling fluid 250*f* (and lubricant 250*o* via balance piston 204) and the returns 250*r* may be correspondingly equalized or substantially equalized. Alternatively, the first predetermined flow rate may instead be a flow rate sufficient to operate the bit motor 110, the BHA motor 201, and/or the MWD module 115.

Fluid pressure across the pistons 212, 222 may subsequently equalize, thereby substantially eliminating or eliminating any actuation force exerted on the pistons 212, 222 by the lubricant 250*o*. The rotary spring 211 may then decompress, thereby moving the rotary piston 212 longitudinally away from the output jaw 218. The rotary piston 212 may carry the rotary cam 210 longitudinally coupled thereto. As the rotary cam 210 longitudinally moves within the upper bearing housing 208, the J-slot may ride along the pin 234, thereby rotating the rotary cam 10 half-way to the next mode, i.e. rotary or sliding, dependant on which mode the orienter 200 was previously in.

The orienting spring 223 may also decompress, thereby moving the orienting piston 222 longitudinally away from the output jaw 218. The orienting piston 222 may carry the orienting cam/jaw 220 longitudinally coupled thereto. As the orienting cam/jaw 220 moves longitudinally, the splines 220*s* may disengage from the splined portion 219*s*, thereby rotationally decoupling the cam/jaw 220 from the clutch housing 219 and deleting the current tool face setting. As the cam/jaw 220 longitudinally moves within the upper bearing housing 208, the J-slot may ride along the pin 221*p*, thereby rotating the cam/jaw 220 half-way to the next tool face setting.

The rotary actuator 216 may be longitudinally biased into engagement with the rotary jaw 217 by the rotary jaw spring 232. The rotary actuator 216 may push the rotary jaw 217 into engagement with the output jaw 218. Engagement of the rotary jaw 217 with the output jaw 218 may rotationally couple the orienting shaft 224 with the rotary shaft 214, thereby also rotationally coupling the BHA rotor 201*r* and the output shaft 230.

Alternatively and as discussed above, the orienter 200 may be switched between rotary and sliding modes without switching to, or bypassing, the neutral position, thereby maintaining the tool face TF setting or orientation of the orienter 200. To shift the orienter 200 into the bypass position, the injection rate may be substantially reduced from the drilling flow rate and/or substantially reducing (or lifting the drill bit 105 from bottomhole) weight exerted on the drill bit 105. The flow rate may be reduced to a second predetermined or bypass flow rate substantially less than the drilling flow rate and substantially greater than zero, such as one-third, one-half, or two-thirds of the drilling flow rate. Due to the reduced pressure differential, the rotary cam spring 211 may decompress, thereby actuating the rotary cam 210, but the fluid force on the orienting piston 222 may remain sufficient to maintain compression of the orienting spring 223, thereby maintaining engagement of the orienting cam/clutch 220 with the jaw housing 219.

The bypass position may be different when shifting from the sliding mode to the rotary mode (not shown as separate Figure; however, see combination of FIGS. 3A and 4D) than when shifting from the rotary mode to the sliding mode (not shown as separate Figure; however, see combination of FIGS. 3A and 5A). When shifting from sliding to rotary mode, the orienting clutch face 220*j* may remain engaged to the lower output jaw face 218*lj*. When shifting from rotary to sliding mode, the jaw faces 218*lj*, 220*j* may likely be misaligned so that the asymmetric teeth contact, thereby generating a frictional torque. Since there may be little or no weight exerted on the drill bit 105 and/or substantially reduced flow through the bit motor 110, the reactive torque exerted by the bit motor 110 may be insufficient to overcome the frictional torque and counter rotate the output shaft 230.

Alternatively, the orienter 200 may be shifted into the bypass position by ceasing or substantially ceasing injection of the drilling fluid for an interval of time sufficient to allow decompression of the rotary cam spring 211 but insufficient to allow decompression or substantial decompression of the orienting spring 223.

Figures 4A, 4B:
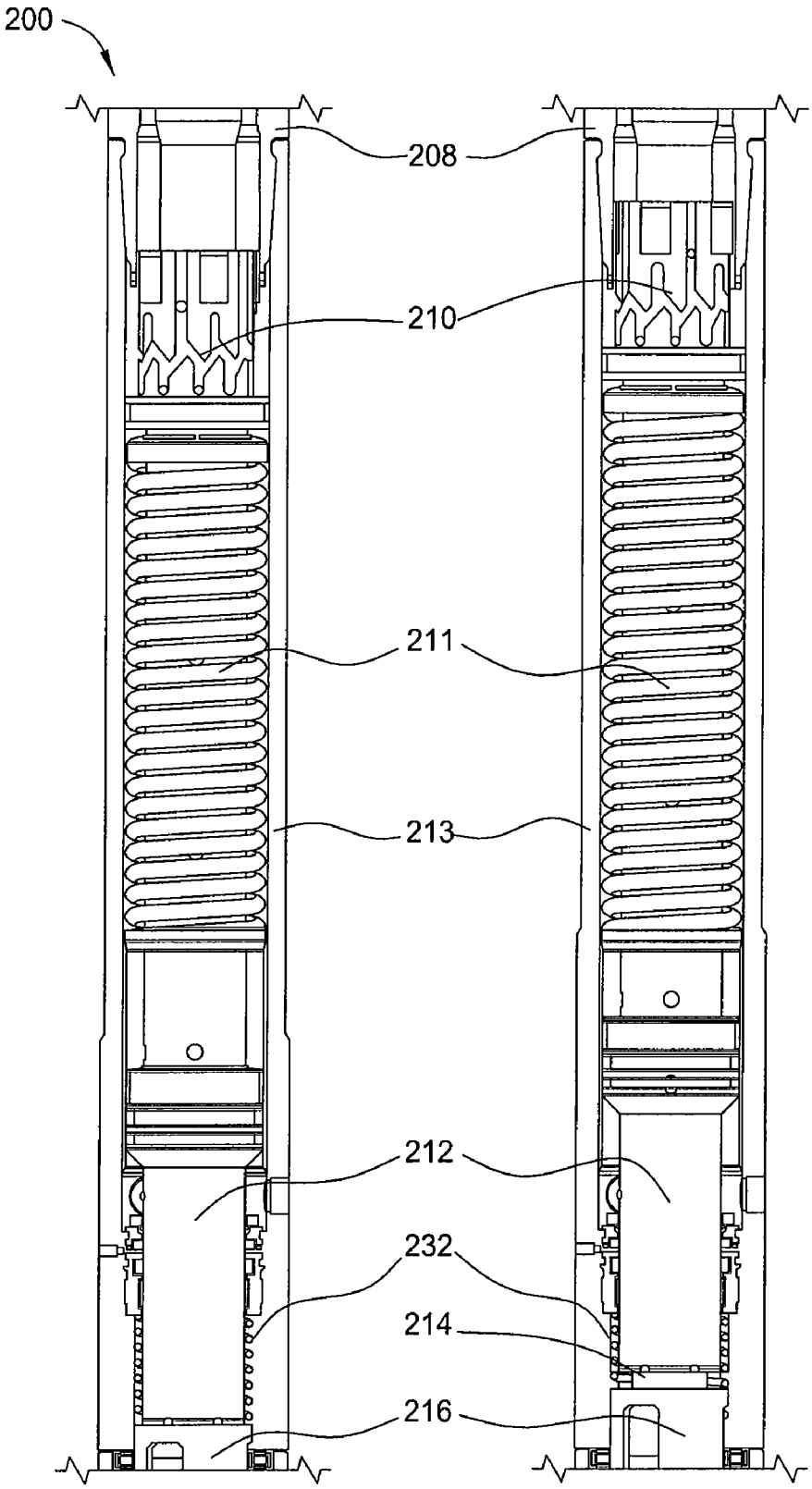
FIGS. 4A-4D are isometric side-by-side views comparing a portion of the clutch subassembly in rotary mode (FIGS. 4A and 4C) and sliding mode (FIGS. 4B and 4D).
Figures 4C, 4D:
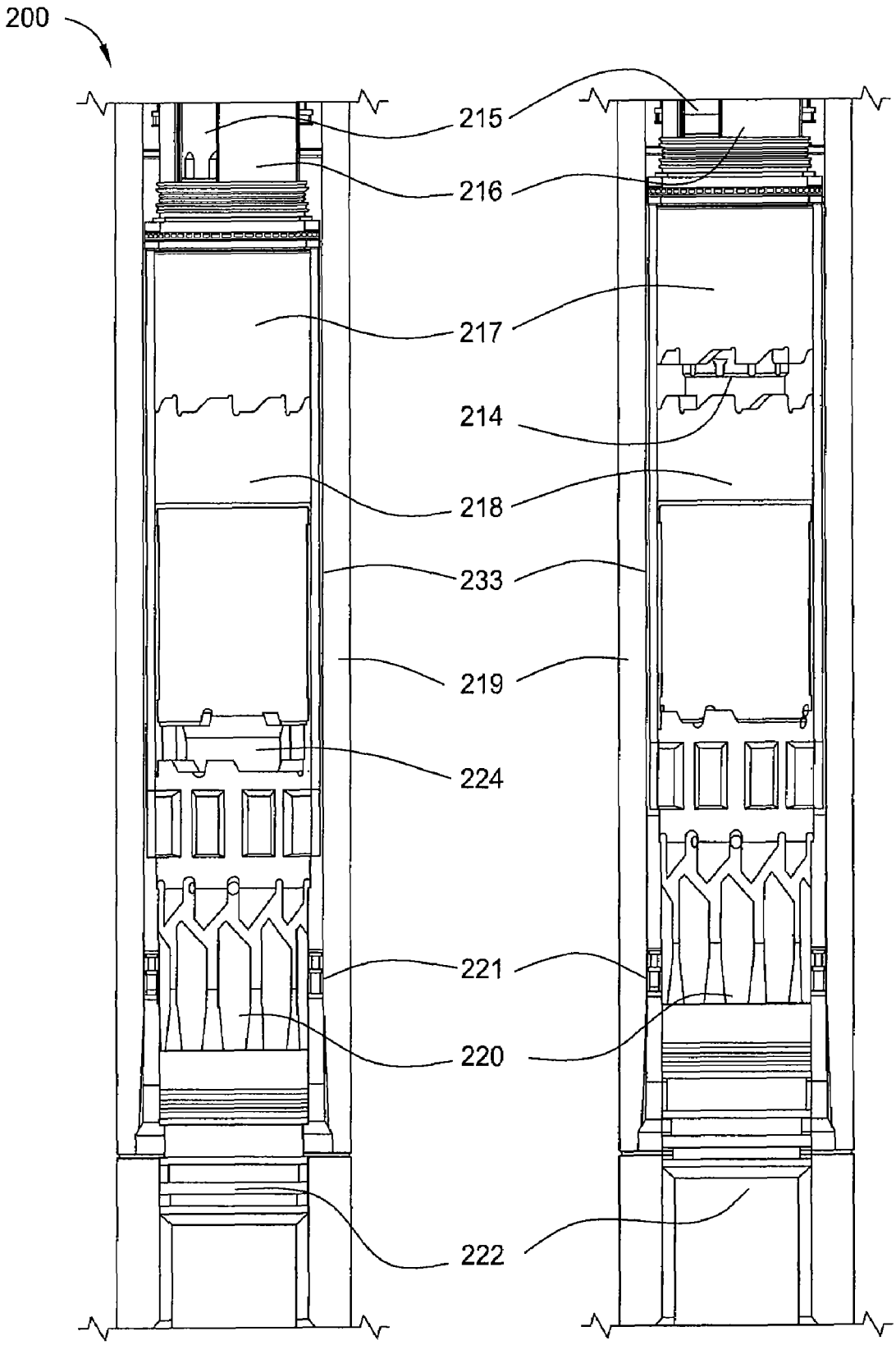

FIGS. 4A-4D are isometric side-by-side views comparing a portion of the clutch subassembly C in rotary mode (FIGS. 4A and 4C) and sliding mode (FIGS. 4B and 4D). To shift the orienter 200 from either the bypass position or the neutral position to the rotary or sliding mode, an injection rate of the drilling fluid 250*f* is increased to the drilling flow rate and/or weight is exerted on the drill bit 105. The pressure differential between the drilling fluid 250*f* (and lubricant 250*o* via balance piston 204) and the returns 250*r* is correspondingly increased due to pressure loss through the bit motor 110 and the drill bit 105.

Due to the differential pressure, an actuation force may be exerted on the rotary piston 212 by the lubricant 250*o*, thereby moving the rotary piston 212 longitudinally toward the rotary actuator 216 and compressing the rotary cam spring 211. The rotary piston 212 may carry the rotary cam 210 longitudinally coupled thereto. As the rotary cam 210 longitudinally moves within the upper bearing housing 208, the J-slot may continue along the pin 234, thereby completing rotation of the rotary cam 210 to the next mode, i.e. rotary or sliding, dependant on which mode the orienter 200 was previously in.

Referring to FIGS. 4A and 4C, if the previous mode was sliding mode, the orienter 200 may switch to rotary mode. The keys 210*k* may align with the keyways formed in the upper bearing housing 208, thereby allowing longitudinal passage of the rotary cam 210 and the upper sleeve portion 212*us* (longitudinally coupled thereto) through the lower longitudinal end of the upper bearing housing 208 and into the upper longitudinal end of the rotary housing 213. Longitudinal movement may continue until the lower sleeve 212*ls* engages the rotary actuator 216. The rotary actuator 216 may push the rotary jaw 217 into engagement with the output jaw 218. Engagement of the rotary jaw 217 with the output jaw 218 may rotationally couple the orienting shaft 224 with the rotary shaft 214, thereby also rotationally coupling the BHA rotor 201*r* and the output shaft 230. The rotary jaw 217 may also push against the sleeve portion 233*s* of the jaw shifter 233.

The cam/jaw 220 may be disengaged from the output jaw 218 by the jaw shifter 233. Specifically, the collet portion 233*c* may engage the splines 220*s*, thereby pushing the jaw face 220*j* from the lower jaw face 218*lj*. As discussed above, since the net effective piston area of the orienting piston 222 may be less than the piston area of the rotary piston 212, the rotary piston 212 may exert a greater downward force on the jaw shifter 233 than the upward force exerted by the orienting piston 222. The cam/jaw 220 may remain engaged with the jaw housing 219 in rotary mode so that the tool face setting is retained. Specifically, the splined portion 219*s* may have sufficient length so that the collet portion 233*c* may hold the jaw face 220*j* away from the lower jaw face 218*lj* while the splines 220*s* remain engaged to the splined portion 219*s*.

Referring to FIGS. 4B and 4D, if the previous mode was rotary mode, the orienter 200 may switch to the sliding mode. The keys 210*k* may align with and engage the keys formed in the upper bearing housing 208, thereby restraining longitudinal movement of the rotary cam 210. The rotary piston 212, longitudinally coupled to the rotary cam 210, may be consequently prevented from moving longitudinally toward and engaging the rotary actuator 216. The longitudinal restraint of the rotary piston 212 may allow the orienting piston 222 to disengage the rotary jaw 217 from the output jaw 218 and engage the orienting cam/jaw 220 with the output jaw 218 and the jaw housing 219, thereby rotationally coupling the output shaft 230 to the jaw housing 219. Specifically, the splines 220*s* may push the collet portion 233*c* and the sleeve portion 233*s* may push the thrust bearing 238 and the thrust bearing 238 may push the rotary jaw 217 and the rotary jaw 217 may push the thrust bearing 237 and the thrust bearing 237 may push the rotary actuator 216 and the rotary actuator 216 may compress the rotary jaw spring 232.

Due to rotation of the output jaw 218 in rotary mode, the output jaw 218 and the orienting cam/jaw 220 may likely be misaligned so that the orienter 200 shifts into orienting mode (see FIGS. 5A and 5B) to rotationally align the asymmetric jaw faces 218*lj*, 220*j* for engagement, thereby restoring the previous tool face setting (assuming the bypass position is used to shift the orienter from rotary to sliding mode and not the neutral position). Once the orientation cam/jaw 220 and the output jaw 218 are engaged, the orienter 200 is rotationally locked in the sliding mode at the previously set tool face orientation.

FIGS. 5A and 5B are isometric views illustrating a portion of the clutch subassembly C in the orienting mode. The orienter 200 may shift into the orienting mode either to restore a previous tool face setting when shifting from rotary to sliding mode using the bypass position or to enter a new tool face setting when shifting from the neutral position to the sliding mode.

Starting from the neutral position and assuming the last mode was the rotary mode so that the next mode is the sliding mode, the injection rate of the drilling fluid 250*f* may be increased to the drilling flow rate and the pressure differential between the drilling fluid 250*f* (and lubricant 250*o* via balance piston 204) and the returns 250*r* is correspondingly increased due to pressure loss through the bit motor 110 and the drill bit 105. Due to the differential pressure, an actuation force may be exerted on the orienting piston 222 by the lubricant 250*o*, thereby moving the orienting piston 222 longitudinally toward the output jaw 218 and compressing the orienting spring 223. The orienting piston 222 may carry the orienting cam/jaw 220 longitudinally coupled thereto.

As the cam/jaw 220 longitudinally moves within the upper bearing housing 208, the J-slot may continue along the pin 221*p*, thereby completing rotation of the cam/jaw 220 to the next tool face setting. Longitudinal movement may continue until the splines 220*s* engage the spline portion 219*s*, thereby rotationally coupling the cam/jaw 220 and the jaw housing 219 at the new tool face setting. Longitudinal movement may continue until the splines 220*s* engage the jaw shifter 233, thereby disengaging the rotary jaw 217 from the output jaw 218. Longitudinal movement may continue until contact of the misaligned jaw faces 218*lj*, 220*j*. Once contact is made, reactive (i.e., counterclockwise) rotation of the jaw face 218*lj* by the bit motor 110 relative to the jaw face 220*j* may be required until the jaw faces 218*lj*, 220*j* align and engage. Once the orientation cam/jaw 220 and the output jaw 218 are engaged, the orienter is rotationally locked in the sliding mode at the new tool face orientation.

If the last mode was sliding mode so the next mode is rotary mode, the orienter 200 may not enter the orienting mode. The new tool face setting may be retained by engagement of the splines 220*s* with the splined portion 219*s*; however, the orientation cam/jaw 220 may be unable to disengage the rotary jaw 217 from the output jaw 218 due to engagement of the rotary piston 212 with the rotary actuator 216 so that the new tool face setting may not be entered until the orienter is shifted from the rotary mode to the sliding mode.

Figure 6B:
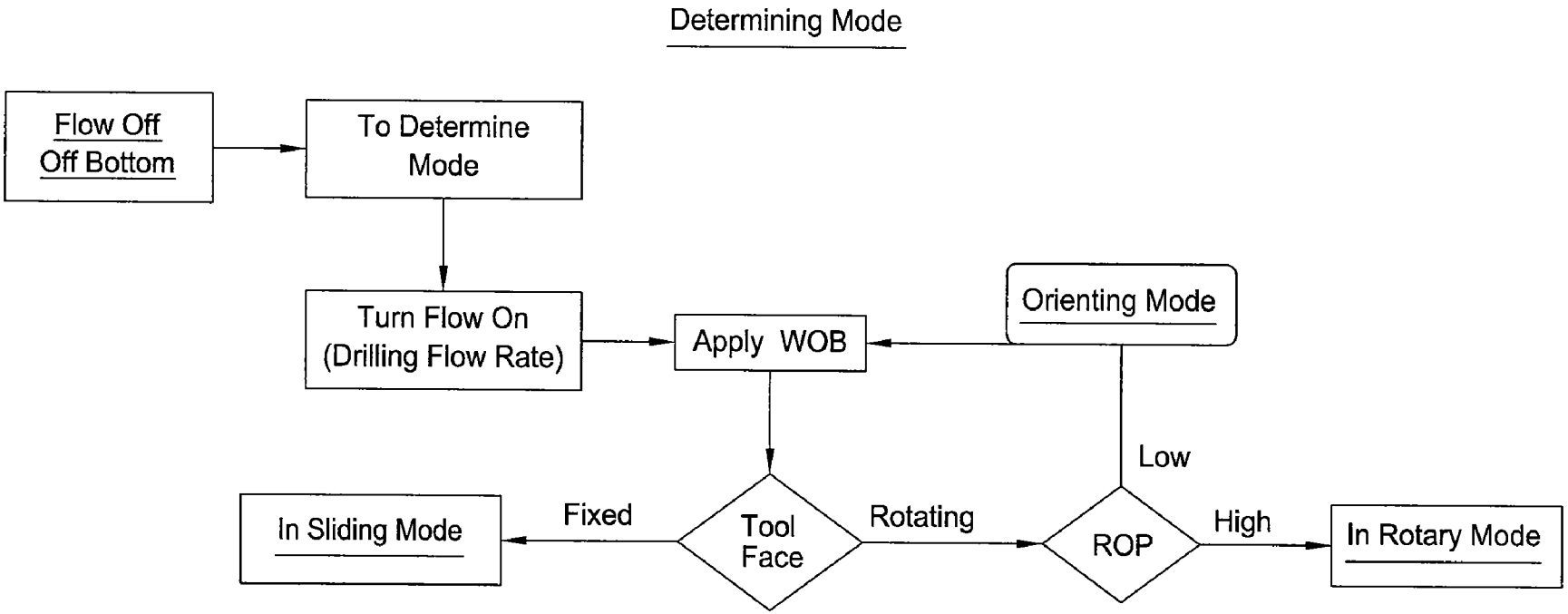

FIG. 6A is a table illustrating surface indicators for determining which mode/position the orienter 200 is in. FIG. 6B is a flow chart illustrating a method for determining which operational mode the orienter 200 is currently in. The indicators may include injection rate or flow rate of drilling fluid 250*f* injected into the coiled tubing string 130 by the rig mud pump, whether the tool face TF (or bent housing 110) is rotating or fixed which may be determined from signals sent by the MWD module, and/or rate of penetration (ROP). A zero injection rate of drilling fluid may indicate that the orienter 200 is in the neutral position due to no differential pressure across the rotary 212 and orienting 222 pistons. A full drilling flow rate may indicate that the orienter is in one of the three operating modes: rotary, orienting, or sliding as a sufficient differential pressure may be exerted on the rotary 212 and orienting 222 pistons to compress the respective springs 211, 223 and both the BHA motor 201 and bit motor 110 may be operating.

A rotationally fixed tool face TF (or bent housing 110) may indicate that the orienter 200 is either in the neutral position or sliding mode because the BHA motor 201 is not operating or the orienting cam/jaw 220 is engaged with the jaw housing 219 and the output jaw 218. A rotating tool face TF (or bent housing 110) may indicate that the orienter 200 is in rotary mode or orienting mode because the BHA motor 201 may be rotating the output shaft 230 or the bit motor 110 is counter-rotating the output shaft 230. The rotary mode and the orienting mode may further be distinguished by calculating a rate in change of tool face TF orientation (i.e., right-hand rotational velocity positive and left-hand rotational velocity negative). A low ROP may indicate orienting mode because the bit motor 110 is counter-rotating the output shaft 230 instead of, or in addition to, the drill bit 105.

Figure 6C:
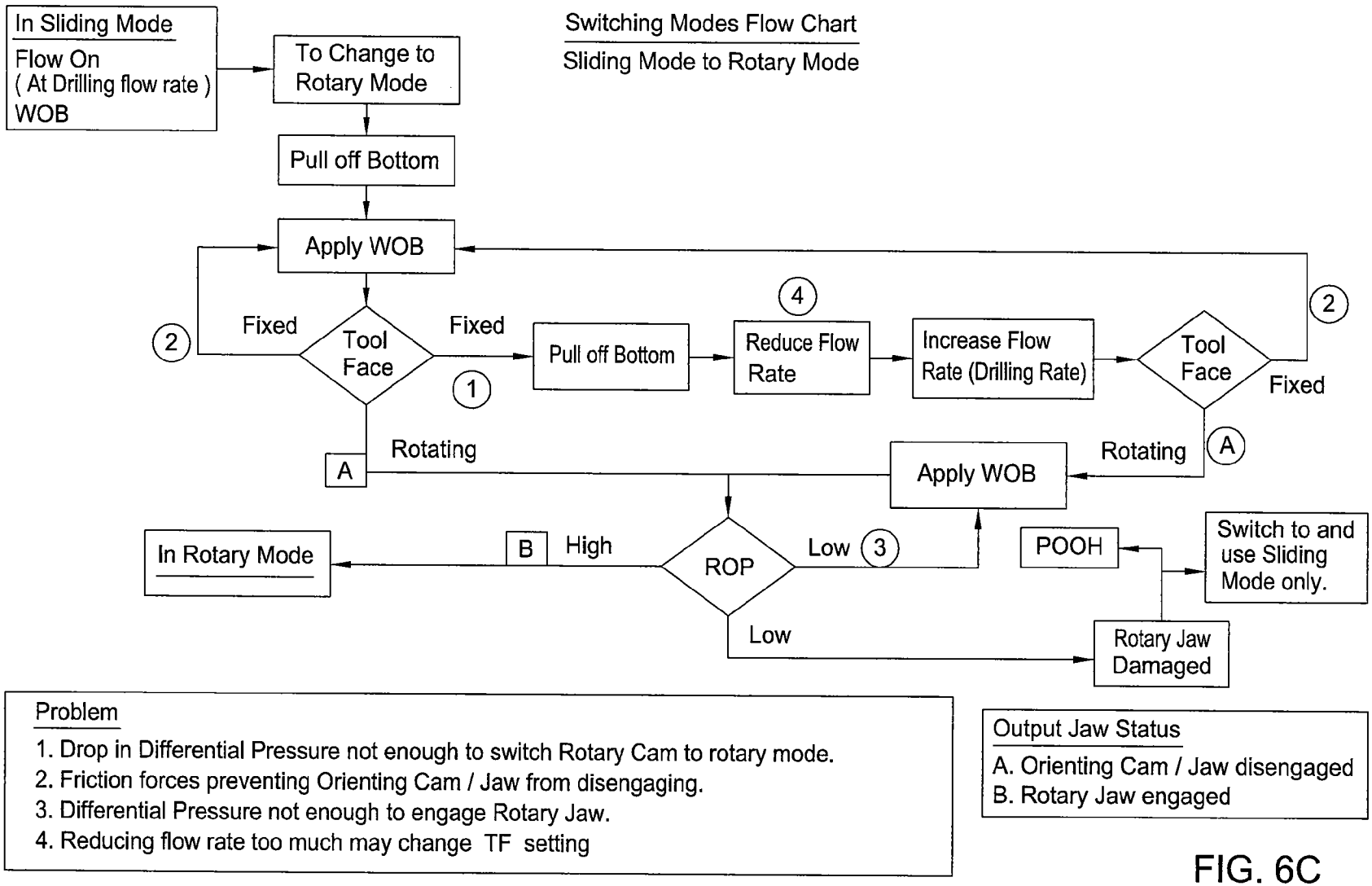
FIG. 6C is a flowchart illustrating a method for switching the orienter from the sliding mode to the rotary mode.

FIG. 6C is a flowchart illustrating a method for switching the orienter 200 from the sliding mode to the rotary mode using the bypass position. Starting from the orienter 200 in sliding mode with drilling fluid 250*f* being injected through the BHA 100 at the drilling flow rate and with weight exerted on the drill bit, a first attempt may be made to shift the orienter 200 by lifting the drill bit 105 from the bottom of the wellbore and then exerting weight back on the drill bit 105. Injection of the drilling fluid 250*f* may be maintained at the drilling rate for the first attempt. The pressure differential across the rotary piston 212 may be sufficiently reduced to index the rotary cam 210 and disengage the orienting cam/jaw 220 from the output jaw 218 and as indicated by a rotating tool face TF (or bent housing 110). If so, then the ROP may be monitored to determine if the rotary jaw 217 has engaged the output jaw 218 as indicated by a high ROP. If so, then the orienter 200 has successfully shifted from sliding mode to the bypass position to the rotary mode.

If the tool face TF is rotating but the ROP is low, then the differential pressure may be insufficient to engage the rotary jaw 217 with the output jaw 218. A remedial step of increasing the weight exerted on the drill bit 105 and/or increasing the injection rate of the drilling fluid 250*f* may be attempted to increase the differential pressure exerted on the rotary piston 212. If the remedial step fails, the rotary jaw 217 may be damaged, thereby necessitating pulling of the orienter 200 from the wellbore or hole (POOH) for servicing. As an alternative, use of the orienter 200 may continue but be restricted to sliding mode.

If the tool face TF remains rotationally fixed after the first attempt, the decrease in differential pressure may be insufficient to index the rotary cam 210 or friction may be holding the orienting cam/jaw 220 and the output jaw 218 together. A remedial step of increasing the weight exerted on the drill bit 105 and/or increasing the injection rate of the drilling fluid 250*f* may be attempted to increase the differential pressure exerted on the rotary piston 212, thereby increasing the force exerted on the gear shifter 233 to attempt to dislodge the orienting cam/jaw 220 from the output jaw 218. If the remedial step fails, then it may be assumed that the rotary cam did not engage. The drill bit 105 may be lifted from the bottomhole and the flow rate reduced to the bypass flow rate, discussed above, to further reduce the differential pressure acting on the rotary piston 212. The flow rate may then be increased back to the drilling flow rate and the tool face TF may be checked for rotation. If the tool face TF is rotating, then weight may be applied to the drill bit 105 and the ROP may be checked, as discussed above. If the tool face TF remains fixed, then the remedial step may be repeated. If the remedial step fails, then the drill bit 105 may be lifted from the bottomhole and the flow rate ceased to positively assure that the rotary cam 210 indexes (although the orienting cam/jaw 220 may also index as well). The tool face TF may again be checked for rotation. If the tool face TF remains fixed, then the orienter 200 may be removed from the wellbore for servicing.

Figure 6D:
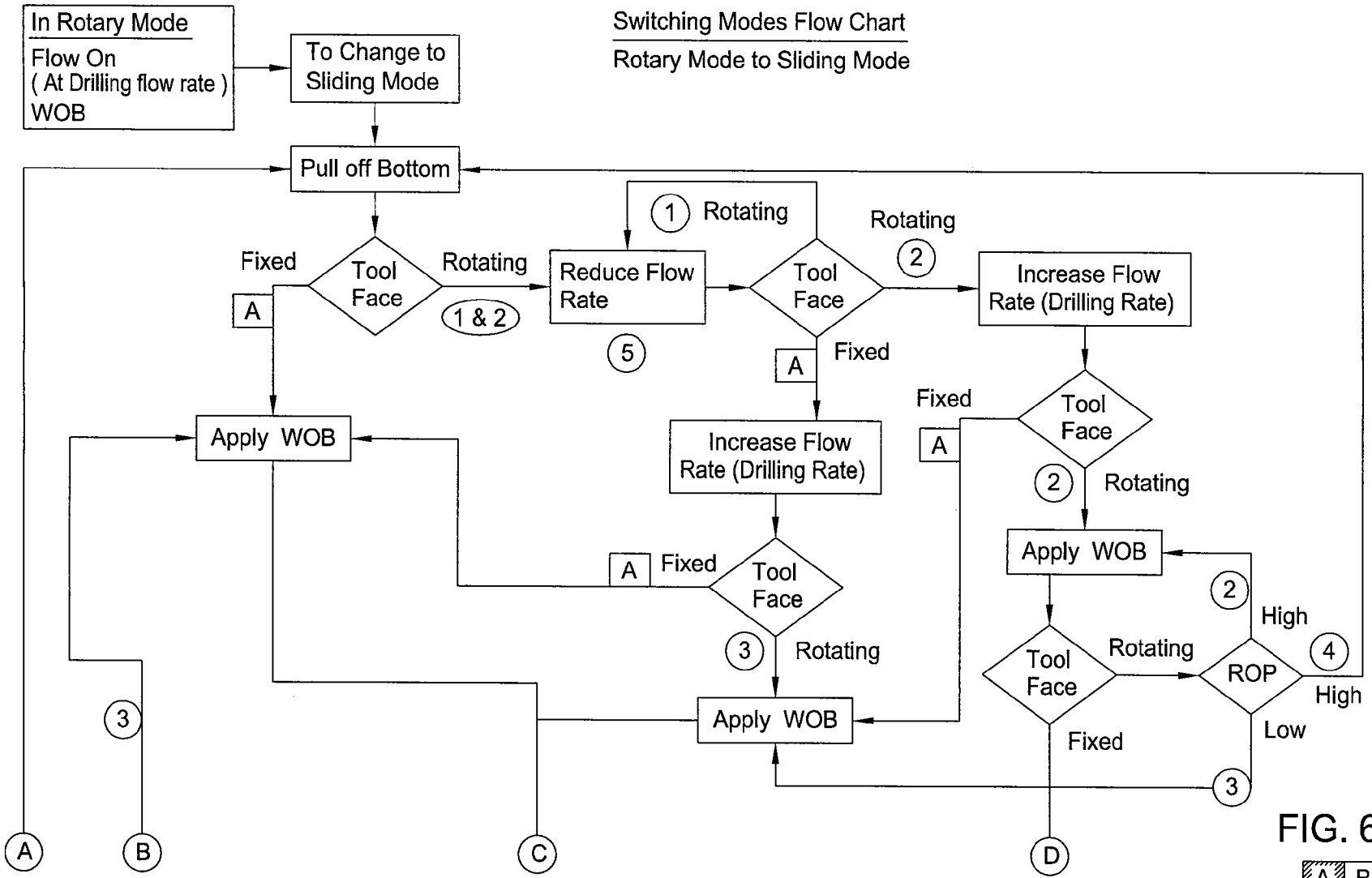
FIG. 6D is a flowchart illustrating a method for switching the orienter from the rotary mode to the sliding mode.
Figure 6D:
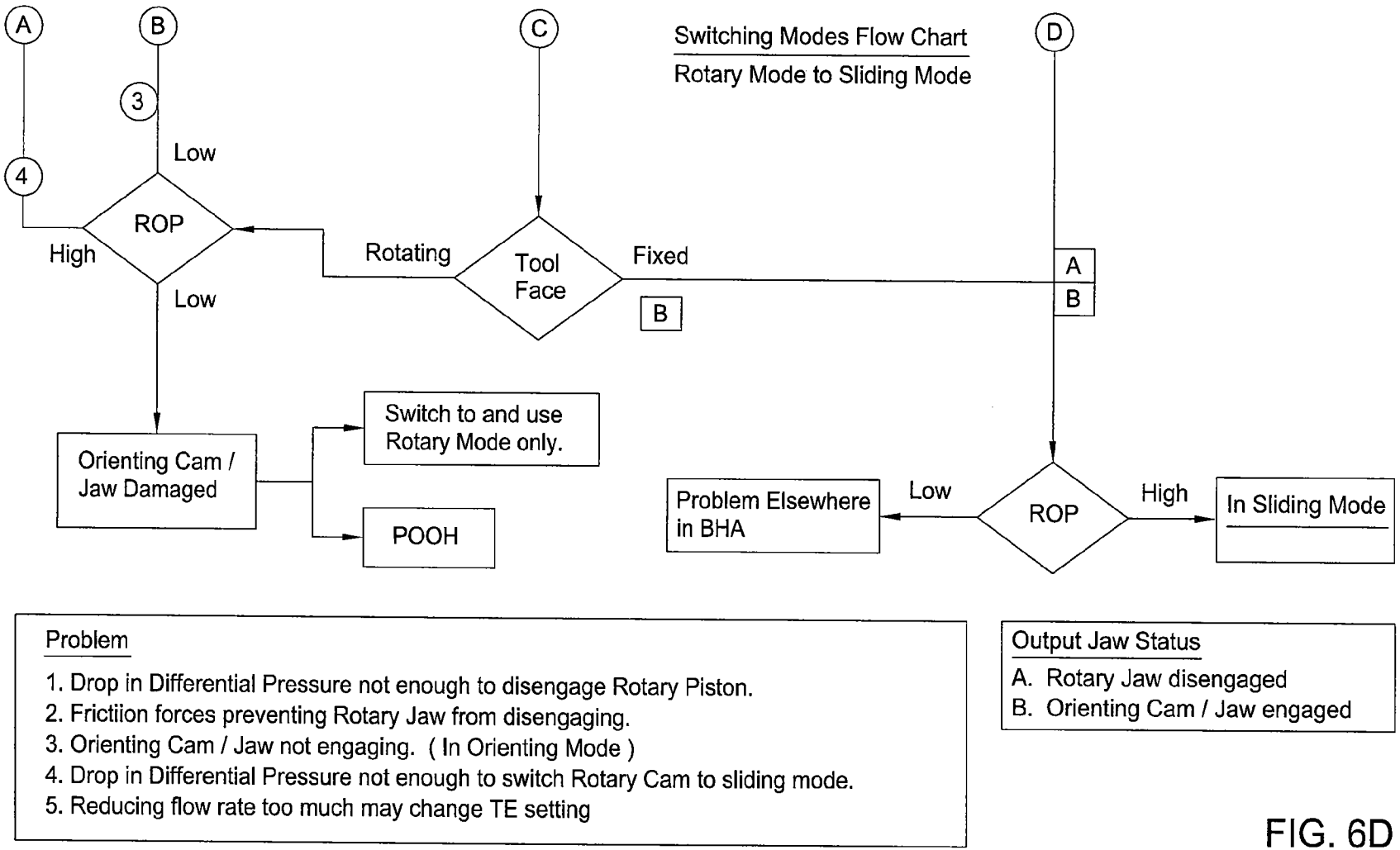

FIG. 6D is a flowchart illustrating a method for switching the orienter 200 from the rotary mode to the sliding mode using the bypass position. Starting from the orienter 200 in rotary mode with drilling fluid 250*f* being injected through the BHA 100 at the drilling flow rate and with weight exerted on the drill bit 105, a first attempt may be made to shift the orienter 200 by lifting the drill bit 105 from the bottom of the wellbore. Injection of the drilling fluid 250*f* may be maintained at the drilling rate for the first attempt. The pressure differential across the rotary piston 212 may be sufficiently reduced to disengage the rotary jaw 217 from the output jaw 218 as indicated by a rotationally fixed tool face TF (or bent housing 110). As discussed above, the jaw faces 218*lj*, 220*j* may contact but there may be insufficient counter torque to overcome the frictional contact torque. If so, then the weight may be reapplied to the drill bit 105, thereby increasing the counter torque so that the orienter may shift into orienting mode and align the asymmetric jaw faces 218*lj*, 220*j*. Engagement of the orienting cam/jaw 220 with the output jaw 218 may then be indicated by a rotationally fixed tool face TF. If so, the ROP may be monitored to determine that the BHA 100 is functioning properly as indicated by a high ROP. If so, then the orienter 200 has successfully shifted from rotary mode, to the bypass position, to the orienting mode, and then to the sliding mode.

If the tool face TF is fixed but the ROP is low, then there may be a malfunction elsewhere in the BHA 100, such as a motor failure. If the tool face TF is rotating after weight is exerted on the bit 105, then the differential pressure may be insufficient to engage the orienting cam/jaw 220 with the output jaw 218 as indicated by a low ROP. A remedial step of increasing the weight exerted on the drill bit 105 and/or increasing the injection rate of the drilling fluid 250*f* may be attempted to increase the differential pressure exerted on the orienting piston 222. If the remedial step fails, the orienting cam/jaw 220 may be damaged, thereby necessitating pulling of the orienter 200 from the wellbore or hole (POOH) for servicing. As an alternative, use of the orienter 200 may continue but be restricted to rotary mode.

If the tool face TF is rotating after weight is exerted on the bit 105, then the rotary cam 210 may not have indexed and the rotary jaw 217 may have reengaged with the output jaw 218 as indicated by a high ROP. If so, the decrease in differential pressure may be insufficient to disengage the rotary piston 212 from the rotary jaw 217 or friction may be holding the rotary jaw 217 and the output jaw 218 together. The drill bit 105 may be lifted from the bottomhole and the flow rate reduced to the bypass flow rate, discussed above, to further reduce the differential pressure acting on the rotary piston 212. The tool face TF may then be checked for rotation. If the tool face TF is still rotating, the injection rate of the drilling fluid 250*f* may be increased to the drilling flow rate and the tool face TF again checked for rotation. If the tool face TF is still rotating, then weight may be reapplied to the drill bit 105 and the ROP checked. If the ROP is high, then the injection rate may be increased and/or weight on the bit may be increased. If the tool face TF is still rotating, then the drill bit 105 may be lifted from the bottomhole and injection of the drilling fluid may be ceased. This may result in a change of the tool face TF orientation. Injection of the drilling fluid 250*f* may then be resumed at the drilling fluid rate and the tool face TF again checked. If the tool face TF is still rotating, then weight may be applied to the bit 105 and the ROP checked. If the ROP is still high, then the injection rate may be increased and/or weight on the bit 105 may be increased. If the tool face TF is still rotating, then the orienter 200 may be removed from the wellbore for servicing.

If, after the flow rate is reduced to the bypass flow rate, the tool face TF is fixed, then the injection rate may be increased to the drilling flow rate and weight may be applied to the drill bit 105 and the tool face TF may again be checked, as discussed above. If, after the flow rate is increased to the drilling flow rate, the tool face is fixed, then weight may be applied to the drill bit 105 and the tool face TF may again be checked, as discussed above. If, after weight is applied to the drill bit 105, the tool face TF is fixed, then the ROP may be checked, as discussed above.

Figure 6E:
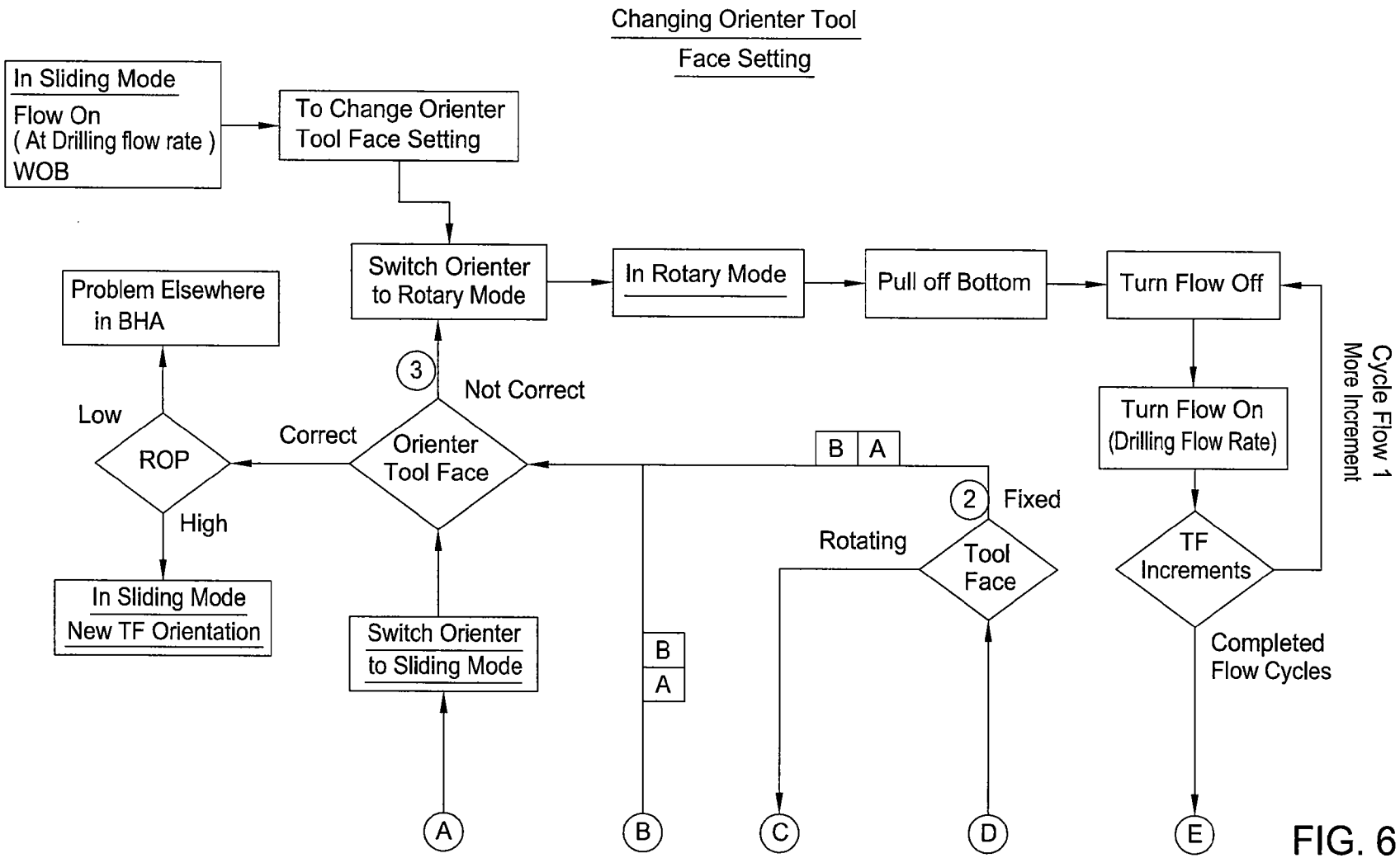
FIG. 6E is a flowchart illustrating a method for changing the tool face setting of the orienter.
Figure 6E:
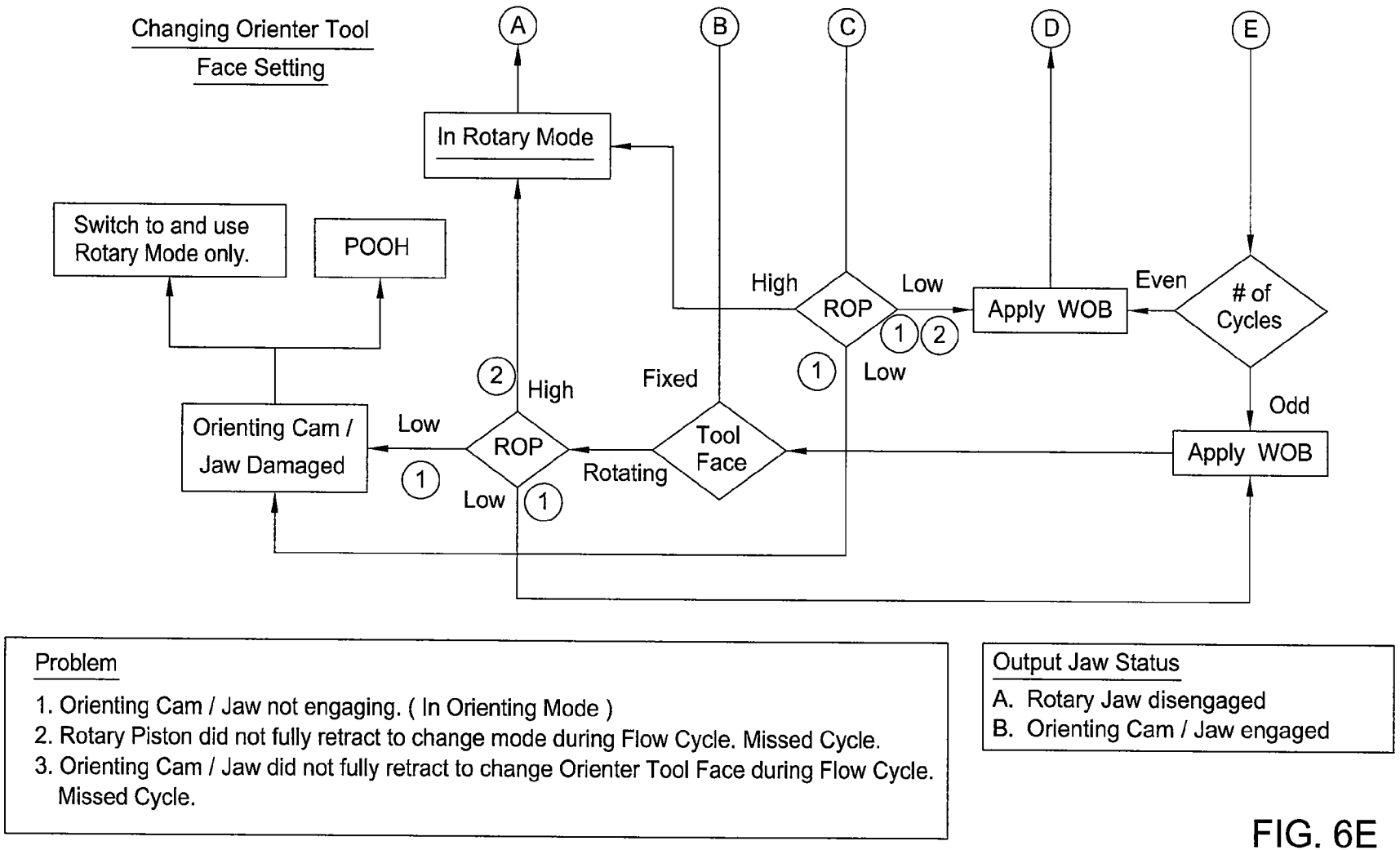

FIG. 6E is a flowchart illustrating a method for changing the tool face TF setting or orientation. Starting from the orienter 200 in sliding mode with drilling fluid being injected through the BHA 100 at the drilling flow rate and with weight exerted on the drill bit 105, the orienter 200 may be switched to rotary mode using the bypass position (see FIG. 6C, above). Once in rotary mode, the injection of drilling fluid 250*f* may be ceased and then resumed after a predetermined increment of time sufficient to allow expansion of the orienting spring 223. If the new desired orientation requires more than one increment, the drilling fluid 250*f* flow may again be cycled as many times as necessary to achieve the new desired orientation. If the number of cycles performed is odd, then the orienter 200 may be back in sliding mode since the rotary cam 210 may have indexed as well as the orienting cam/jaw 220. If so, then weight may be applied to the bit 105 and the tool face TF checked for rotation. If the tool face TF is fixed, then the orientation of the tool face TF may be checked using the MWD module 115. If the tool face TF orientation is correct, then the ROP may be checked to ensure the BHA 100 is properly functioning. If the ROP is high, then the tool face TF setting has been successfully changed and the orienter 200 has been successfully shifted back into sliding mode at the new desired orientation.

If the number of cycles performed is even, then the orienter 200 may be in rotary mode. Weight may be applied to the drill bit 105 and the tool face TF checked for rotation. If the tool face TF is rotating, then the ROP may be checked. A high ROP may verify that the orienter 200 is in rotary mode. The orienter 200 may then be shifted back into sliding mode using the bypass position so that the orientation is not unintentionally changed. Once the orienter 200 is shifted back into sliding mode, then the orientation of the tool face may be checked, as discussed above.

If the orientation is not correct in either of the above cases, then the orienting cam/jaw 220 may not have indexed during one or more of the flow cycles. The orienter 200 may be shifted into rotary mode, the bit 105 lifted from the bottomhole, and the flow cycling repeated to correct the deficient orientation. If the tool face TF is fixed after an even number of cycles or rotating after an odd number of cycles, then the rotary piston 212 may not have retracted sufficiently to index the rotary cam 210 and the orienter 200 may be in rotary mode when the orienter 200 should be in sliding mode and vice versa. However, the orienting cam/jaw 220 may still have indexed for each cycle so the orientation may still be correct. If the orienter 200 is in rotary mode, then the orienter 200 may be shifted into sliding mode using the bypass position and the orientation of the tool face TF checked, as discussed above. If the orienter 200 is in sliding mode, then the orientation of the tool face TF may be checked, as discussed above.

The rest of the flow chart illustrates remedies for sticking of the orienter 200 between the sliding and rotary mode, similar to the remedies discussed above for FIGS. 6C and 6D.

While the foregoing is directed to embodiments of the present invention, other and further embodiments of the invention may be devised without departing from the basic scope thereof, and the scope thereof is determined by the claims that follow.

The invention claimed is:

1. A bottom hole assembly (BHA) for use in drilling a wellbore, the BHA comprising:
- a BHA mud motor having a stator and a rotor;
- a drill bit mud motor having a stator and a rotor;
- a drill bit rotationally coupled to the bit rotor and having a tool face and a longitudinal axis inclined relative to a longitudinal axis of the BHA mud motor; and
- a clutch, comprising:
  - an output jaw rotationally coupled to the bit stator and having an asymmetric jaw face; and
  - a rotary jaw rotationally coupled to the BHA rotor,
  - an orienting jaw having an asymmetric jaw face,
- wherein:
  - the clutch is operable to:
    - rotationally couple the bit stator to the BHA stator in a sliding mode at a first orientation of the tool face,
    - rotationally couple the BHA rotor to the bit stator in a rotary mode,
    - change the first orientation to a second orientation by a predetermined increment,
    - orient the tool face at the second orientation in an orienting mode, and
    - shift among the modes in response to at least one of: a change in flow rate of a fluid injected through the clutch and a change in weight exerted on the drill bit,
  - the rotary jaw is engaged to the output jaw in the rotary mode, and
  - the asymmetric jaw faces are engaged in the sliding mode.

2. The BHA of claim 1, wherein:
- the clutch further comprises:
  - a passage for conducting drilling fluid through the clutch
  - a rotary piston longitudinally coupled to the rotary jaw in the rotary mode; and
  - an orienting piston longitudinally coupled to the orienting jaw, and
  - the pistons are each in fluid communication with the passage and an exterior of the clutch.

3. The BHA of claim 2, wherein the clutch further comprises:
- a housing rotationally coupled to the first stator;
- a rotary cam longitudinally coupled to the rotary piston; and
- a rotary cam guide longitudinally and rotationally coupled to the housing and engaged with the rotary cam.

4. The BHA of claim 3, wherein:
- the orienting jaw has a cam profile formed in an outer surface thereof,
- the clutch further comprises an orienting cam guide longitudinally and rotationally coupled to the housing and engaged with the orienting cam profile.

5. The BHA of claim 4, wherein the orienting jaw is rotationally coupled to the housing in the rotary, orienting, and sliding modes.

6. The BHA of claim 5, wherein the rotary piston has a greater effective piston area than the orienting piston.

7. The BHA of claim 6, wherein:
- the clutch further comprises a jaw shifter, the rotary piston engages the jaw shifter and the jaw shifter engages the orienting jaw in the rotary mode, thereby restraining the orienting jaw from engagement with the output jaw, and the orienting piston engages the jaw shifter and the jaw shifter engages the rotary jaw in the sliding mode, thereby restraining the rotary jaw from engagement with the output jaw.

8. The BHA of claim 7, wherein the clutch further comprises:

a rotary cam spring biasing the rotary piston away from the rotary jaw; and an orienting spring biasing the orienting piston away from the output jaw.

9. The BHA of claim 8, wherein a stiffness of the orienting spring is substantially less than a stiffness of the rotary spring.

10. The BHA of claim 1, wherein the bit motor comprises a bent housing or the BHA further comprises a bent sub rotationally coupled to the bit stator, thereby providing the bit inclination.

11. The BHA of claim 1, further comprising a coiled tubing string longitudinally and rotationally coupled to the BHA stator.

12. The BHA of claim 1, further comprising a measurement while drilling (MWD) module comprising a sensor operable to measure orientation of the tool face and a wireless transmitter operable to transmit the measured orientation to the surface.

13. A clutch, comprising:

a tubular housing;

a rotary shaft disposed in the housing;

a rotary jaw rotationally coupled to the rotary shaft;

an output shaft disposed in the housing;

an output jaw rotationally coupled to the output shaft and having an asymmetric jaw face; and an orienting jaw having an asymmetric jaw face, wherein the clutch is fluid operable among:

a rotary mode, wherein the rotary and output jaws are engaged, thereby rotationally coupling the rotary and output shafts, a sliding mode, wherein the asymmetric jaw faces are engaged and the orienting jaw is rotationally coupled to the housing, thereby rotationally coupling the output shaft and the housing, and an orienting mode, wherein the rotary and output jaws are disengaged, the asymmetric jaw faces are contacting and misaligned, and the orienting jaw is rotationally coupled to the housing.

14. A bottom hole assembly (BHA) for use in drilling a wellbore, comprising:

the clutch of claim 13;

a BHA mud motor having a stator longitudinally and rotationally coupled to the housing and a rotor longitudinally and rotationally coupled to the rotary shaft;

a drill bit mud motor having stator longitudinally and rotationally coupled to the output shaft and a rotor; and a drill bit longitudinally and rotationally coupled to the bit rotor.

15. The BHA of claim 14, wherein the bit motor comprises a bent housing or the BHA further comprises a bent sub rotationally coupled to the bit stator.

16. A method of directional drilling a wellbore, comprising:

injecting drilling fluid through a coiled tubing string extending from surface and into the wellbore and a bottom hole assembly (BHA) disposed in the wellbore and connected to an end of the coiled tubing string, wherein:

the BHA comprises a BHA motor, a drill bit motor, a drill bit having a tool face and a longitudinal axis inclined relative to a longitudinal axis of the BHA motor, and a clutch, and the clutch engages the BHA motor with the bit motor in a rotary mode, thereby rotating the bit motor, the bit motor rotates the drill bit, thereby drilling the wellbore;

shifting the clutch to a neutral position from the rotary mode, wherein the clutch changes from a first orientation to a second orientation by a predetermined increment;

shifting the clutch to a sliding mode after shifting the clutch to the neutral position, wherein the clutch:

allows reactive rotation of the bit motor until the tool face is at the second orientation, rotationally couples the bit motor to the coiled tubing string at the second orientation, and disengages the BHA motor from the bit motor; and slide drilling the wellbore at the second orientation.

17. The method of claim 16, wherein the clutch is shifted to the neutral position by ceasing injection of the drilling fluid for a predetermined increment of time.

18. The method of claim 16, further comprising:

slide drilling the wellbore at the first orientation before drilling the wellbore in the rotary mode; and shifting the clutch to the rotary mode before drilling the wellbore in the rotary mode.

19. The method of claim 18, wherein:

the method further comprises shifting the clutch to a bypass position before shifting the clutch to the rotary mode, and the clutch stores the first orientation in the rotary mode.

20. The method of claim 19, wherein the clutch is shifted to the bypass position by lifting the drill bit from a bottom of the wellbore.

21. The method of claim 19, wherein the clutch is shifted to the bypass position by reducing an injection rate of the drilling fluid to a rate substantially less than a drilling flow rate and substantially greater than zero.

22. The method of claim 19, wherein the clutch is shifted to the bypass position by ceasing injection of the drilling fluid and resuming injection of the drilling fluid before passage of a predetermined increment of time, thereby preventing the clutch from shifting to a neutral position and changing the first orientation.

23. A method of directional drilling a wellbore, comprising:

injecting drilling fluid through a coiled tubing string extending from surface and into the wellbore and a bottom hole assembly (BHA) disposed in the wellbore and connected to an end of the coiled tubing string, wherein:

the BHA comprises a BHA motor, a drill bit motor, a drill bit having a tool face and a longitudinal axis inclined relative to a longitudinal axis of the BHA motor, and a clutch, and the clutch engages the BHA motor with the bit motor in a rotary mode, thereby rotating the bit motor, the clutch stores a first orientation in the rotary mode, the bit motor rotates the drill bit, thereby drilling the wellbore;

shifting the clutch from the rotary mode to a bypass position;

shifting the clutch to a sliding mode after shifting the clutch to the bypass position, wherein the clutch:

allows reactive rotation of the bit motor until the tool face is at a first orientation, rotationally couples the bit motor to the coiled tubing string at the first orientation, and disengages the BHA motor from the bit motor; and slide drilling the wellbore at the first orientation.

24. The method of claim 23, wherein the clutch is shifted to the bypass position by lifting the drill bit from a bottom of the wellbore.

25. The method of claim 23, wherein the clutch is shifted to the bypass position by reducing an injection rate of the drilling fluid to a rate substantially less than a drilling flow rate and substantially greater than zero.

26. The method of claim 23, wherein the clutch is shifted to the bypass position by ceasing injection of the drilling fluid and resuming injection of the drilling fluid before passage of a predetermined increment of time, thereby preventing the clutch from shifting to a neutral position and changing the first orientation.

* * * * *